US010959903B2

(12) United States Patent
McNicholl et al.

(10) Patent No.: US 10,959,903 B2
(45) **Date of Patent: *Mar. 30, 2021**

(54) SUPPORT HARNESS

(71) Applicant: James Leckey Design Limited, Lisburn (GB)

(72) Inventors: Christopher McNicholl, Maghaberry (GB); Michelle O'Doherty, Holywood (GB)

(73) Assignee: James Leckey Design Limited, Lisburn (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/023,403

(22) Filed: Jun. 29, 2018

(65) Prior Publication Data

US 2018/0303701 A1 Oct. 25, 2018

Related U.S. Application Data

(63) Continuation of application No. 15/248,473, filed on Aug. 26, 2016, now Pat. No. 10,016,333.

(30) Foreign Application Priority Data

Aug. 26, 2015 (GB) ..... 1515170

(51) Int. Cl.
*A61H 3/00* (2006.01)
*A61H 3/04* (2006.01)
(Continued)

(52) U.S. Cl.
CPC ..... *A61H 3/008* (2013.01); *A61H 3/04* (2013.01); *A61H 2003/007* (2013.01); *A61H 2003/046* (2013.01); *A61H 2201/0119* (2013.01); *A61H 2201/0161* (2013.01); *A61H 2201/0165* (2013.01); *A61H 2201/0192* (2013.01); *A61H 2201/1253* (2013.01); *A61H 2201/1284* (2013.01); *A61H 2201/164* (2013.01); *A61H 2201/1614* (2013.01);
(Continued)

(58) Field of Classification Search
CPC .... A61H 3/008; A61H 3/04–2003/043; A61H 2201/1652; A61G 5/14; A61G 7/1051
See application file for complete search history.

(56) References Cited

U.S. PATENT DOCUMENTS 2,650,725 A 9/1953 Hoyer
2,719,568 A 10/1955 Webb
(Continued)

FOREIGN PATENT DOCUMENTS

CN 104027226 9/2014

OTHER PUBLICATIONS

UK Examination Report for corresponding UK Application No. GB1515170.7, dated Feb. 23, 2016.

*Primary Examiner* — Jennifer Robertson
(74) *Attorney, Agent, or Firm* — Gardner Linn

(57) ABSTRACT

A system for coupling a user to a support apparatus includes a harness for the user, a hoist, and frame. The harness and the hoist have co-operable attachment means for releasably coupling the harness to the hoist. The frame is configured to receive the user, where the harness and the frame have co-operable attachment means for releasably coupling the harness to the frame.

19 Claims, 22 Drawing Sheets

(51) Int. Cl.

| | |
|---|---|
| ***A63B 21/00*** | (2006.01) |
| ***A63B 69/00*** | (2006.01) |
| ***A63B 71/00*** | (2006.01) |
| ***A63B 21/055*** | (2006.01) |
| ***A63B 21/068*** | (2006.01) |
| ***A63B 21/16*** | (2006.01) |
| ***A63B 22/02*** | (2006.01) |
| ***A63B 22/06*** | (2006.01) |

(52) U.S. Cl.

CPC ..... *A61H 2201/1619* (2013.01); *A61H 2201/1621* (2013.01); *A61H 2201/1628* (2013.01); *A61H 2201/1635* (2013.01); *A61H 2201/1652* (2013.01); *A61H 2201/50* (2013.01); *A63B 21/00181* (2013.01); *A63B 21/0552* (2013.01); *A63B 21/068* (2013.01); *A63B 21/16* (2013.01); *A63B 21/4005* (2015.10); *A63B 21/4007* (2015.10); *A63B 21/4009* (2015.10); *A63B 21/4011* (2015.10); *A63B 22/02* (2013.01); *A63B 22/0605* (2013.01); *A63B 69/0059* (2013.01); *A63B 69/0062* (2020.08); *A63B 69/0064* (2013.01); *A63B 71/0009* (2013.01); *A63B 2071/0018* (2013.01); *A63B 2071/0063* (2013.01); *A63B 2209/02* (2013.01); *A63B 2209/08* (2013.01); *A63B 2209/10* (2013.01); *A63B 2210/50* (2013.01); *A63B 2225/093* (2013.01)

(56) References Cited

U.S. PATENT DOCUMENTS

| | | | | |
|---|---|---|---|---|
| 4,941,497 | A * | 7/1990 | Prather | A61H 3/008 135/67 |
| 5,333,333 | A | 8/1994 | Mah | |
| 5,502,851 | A | 4/1996 | Costello | |
| 6,139,475 | A * | 10/2000 | Bessler | A61H 3/008 482/66 |
| 6,436,011 | B1 | 8/2002 | Cook | |
| 6,463,886 | B1 | 10/2002 | Rodden et al. | |
| 6,578,594 | B1 | 6/2003 | Bowen et al. | |
| 6,752,776 | B2 | 6/2004 | West | |
| 8,480,602 | B1 | 7/2013 | Cook | |
| 9,364,735 | B2 | 6/2016 | Beane | |
| 9,452,102 | B2 * | 9/2016 | Ledea | A61H 3/04 |
| 9,649,243 | B2 * | 5/2017 | Johnson | A63B 69/0064 |
| 10,016,333 | B2 * | 7/2018 | McNicholl | A61H 3/008 |
| 10,272,284 | B2 * | 4/2019 | Bellman | A63B 22/0046 |
| 2003/0162636 | A1 * | 8/2003 | West | A61H 3/008 482/69 |
| 2004/0230150 | A1 | 11/2004 | West | |
| 2012/0042917 | A1 | 2/2012 | Workman et al. | |
| 2014/0276306 | A1 | 9/2014 | Dreske | |
| 2019/0143173 | A1 * | 5/2019 | Fung | A63B 24/0003 482/8 |

* cited by examiner

SUPPORT HARNESS

CROSS REFERENCE TO RELATED APPLICATIONS

The present application is a continuation of U.S. patent application Ser. No. 15/248,473, filed Aug. 26, 2016, now U.S. Pat. No. 10,016,333, which claims the priority benefit of U.K. patent application Ser. No. GB1515170.7, filed Aug. 26, 2015, which are hereby incorporated herein by reference in their entireties.

FIELD OF THE INVENTION

This invention relates to a postural support harness and in particular to a system for coupling a user to other articles via the harness.

BACKGROUND OF THE INVENTION

It is common practice for support frames for those with a disability to incorporate a harness to support the primary user therein; these are commonly seen in support apparatus such as those present in swimming pools or those which aid in walking for example. However, it can be a difficult task for carers to transfer users between these various apparatus as it can be a delicate and time consuming process to undo and redo a multitude of straps and clasps of various apparatus. Typically, when inserting a user into a support apparatus a lot of time is expended by the carers ensuring that the user is inserted as per their own needs. This, therefore, means that moving a user between multiple apparatus can be a particularly difficult task.

Some support frames make use of harnesses with which to suspend the user therein. These harnesses are typically an integral part of the support apparatus and are not readily interchangeable, and therefore providing significant numbers of support apparatus in institutions, such as schools and care centres, can be expensive and create difficulties with regard to storage space. Additionally, users are often hoisted into different support apparatus using a sling. These slings can be difficult to don/remove when the user is in the support apparatus.

It would be desirable to obviate or mitigate at least some of the problems described above.

SUMMARY OF THE PRESENT INVENTION

Accordingly, a first aspect of the present invention provides a system for coupling a user to at least one support apparatus (for example a frame or more than one frame), where the system includes a harness for the user and a hoist. The harness and the hoist have co-operable attachment means for releasably coupling the harness to the hoist. A frame (or multiple frames) is configured to receive the user, where the harness and the frame have co-operable attachment means for releasably coupling the harness to the frame. The frame may be, or be part of, the support apparatus. Typically the harness includes multiple sets of attachment means, one set for the hoist and one or more other set for the at least one frame. It is generally preferable for a plurality of different frames to be provided.

The frame may comprise, or be part of, any one or more of a walker, standing frame, seating apparatus, or exercise apparatus for the user. Also, the attachment means may comprise co-operable harness and apparatus attachment means. The harness attachment means and the apparatus attachment means may comprise one or more releasable, corresponding connector parts, which together provide one or more releasable connectors with one part of each connector being provided on the harness and the respective corresponding other part being provided on the at least one frame.

The apparatus attachment means may comprises at least one, preferably a plurality, of the connector parts provided on the at least one frame. The harness attachment means may comprise at least one, preferably a plurality, of the connector parts provided on the harness. The harness attachment means may comprise a plurality of the connector parts provided on the harness, where a respective one of the connector parts is located upon either side of the harness at a respective location corresponding to the user's side or hip. The harness attachment means may comprise a respective one of the connector parts located on the back of the harness, preferably the upper back at a location corresponding to the user's upper back. The corresponding connector parts may comprise releasable connector parts including any one or more of plug and socket connector parts, hook and loop connector parts, belt and buckle connector parts, and/or other male and female connector parts and/or magnetic connector parts.

The apparatus attachment means may comprise a bracket which has a plurality of connector parts provided thereon. The bracket may comprise an inverted T-shaped bracket, where the bracket comprises a lateral portion and a central longitudinal portion, where the ends of the lateral portion comprise pivotable arms, where at least one of the connector parts is provided on each arm, and where at least one is provided on the central longitudinal portion. The pivotably coupled arms may be configured to allow for attachment of the harness to the apparatus attachment means for users of various dimensions.

Optionally, the bracket comprises an inverted T-shaped bracket, wherein the bracket comprises a lateral portion and a central longitudinal portion, wherein the ends of the lateral portion comprise fixed arms, wherein at least one of the connector parts is provided on each arm. Optionally, the connector parts are incorporated within the arms, wherein the connector part is variable between extended and retracted states by an actuator. The actuator may comprise a resiliently biased button, which is typically configured to bias the connector part towards the extended state. The bracket may have a shoulder support provided thereon, typically upon the top end of the central longitudinal portion which is coupleable to the harness. The shoulder support may be configured to support the upper body of the primary user when coupled to the support apparatus in-use.

The shoulder support may comprises a main portion, which is coupled to the central longitudinal portion of the bracket, and at least two branch portions which extend from the body of the main portion, which are configured to wrap around the primary users shoulders in-use. The shoulder coupling arrangement may be provided upon the ends of the branch portions, such that he shoulder coupling arrangement can be releasably connected to a corresponding torso coupling arrangement provided on the harness. The shoulder and torso coupling arrangements may comprise one or more releasable, corresponding connector parts which together provide one or more releasable connectors, one part of each connector being provided on the harness and the respective corresponding other part being provided on the shoulder support.

The system may further includes a hoist and the harness and hoist have co-operable attachment means for releasably coupling the harness to the hoist. The hoist attachment means includes at least one hoist point at which the harness may be releasably coupled to the hoist. Optionally, the at least one hoist point is located at the shoulder or upper torso region of the harness. Optionally, the at least one respective hoist point is provided on the left of the harness at least one respective hoist point is provided on the right of the harness. Also, optionally, at least one respective hoist point is provided on the front of the harness and at least one respective hoist point is provided on the back of the harness.

The hoist attachment means may comprise at least one connector is provided at each hoist point. Optionally, the hoist attachment means comprises at least one respective strap coupled to, preferably releasably coupled to, the harness at the or each hoist point. Optionally, the hoist points comprise at least one adjustable strap or ring or hook or other connector provided on the harness.

Another aspect the invention provides a harness incorporating a postural support structure and means for releasably attaching the harness to at least one frame. The postural support structure may comprise a rigid and/or semi-rigid structure. Optionally, the postural support structure comprises a single piece structure. The postural support structure may also comprise a plurality of individual support members. Optionally, the postural support structure is removable from the harness. The postural support structure may extend in a substantially horizontal and/or vertical direction within the harness relative to an upright user. The postural support structure may comprise a rib like structure which extends substantially around the body of the primary user in use. Optionally, the postural support structure is moulded to the user's shape.

The harness attachment means may comprise a plurality of connector parts provided on the harness, wherein a respective one of the connector parts is located upon either side of the harness at a respective location corresponding to the user's side or hip. The harness attachment means may comprise a respective one of the connector parts located on the back of the harness, preferably the upper back at a location corresponding to the user's upper back. Optionally, the harness incorporates a plurality of thigh straps and/or arm straps. Optionally, the harness includes at least one hoist point at which the harness may be releasably coupled to the hoist. Optionally, the harness comprises first and second portions which are coupleable together at opposing front and rear sides such as define a substantially tubular shaped garment. The first and second portions may be coupleable together at one side by a releasable coupling and at the opposing side by a fastening arrangement. The releasable coupling may be configured to vary between open and closed states such as to allow the harness to be easily placed upon a user. The fastening arrangement may be configured to tighten or loosen the harness such as to accommodate users of varying dimension. The fastening arrangement may comprise a strap which extends, substantially criss-cross, between the first and second portions. A portion of the strap may extend around, at least part of, the circumference of the harness, where the portion is configured such as to provide means by which the fastening arrangement may be tightened or loosened when the harness is upon the primary user in-use.

The embodiments of the invention obviate or mitigate problems typically associated with support frames by providing a system for transferring a user between a plurality of frames thereby reducing the difficulty of transferring and coupling users into the apparatus.

A system in accordance with embodiments of the present invention will be described, by way of example only, with reference to the accompanying drawings. It will be understood that no limitation of the invention is thereby intended, further alterations and modifications which would occur to one skilled in the relevant art and having possession of this disclosure are to be considered within the scope of this invention.

These and other objects, advantages and features of the invention will become apparent upon review of the following specification in conjunction with the drawings.

BRIEF DESCRIPTION OF THE DRAWINGS

Embodiment of the invention are now described by way of example and with reference to the accompanying drawings in which like numerals are used to denote like parts and in which.

DETAILED DESCRIPTION OF EMBODIMENTS

Figure 1:
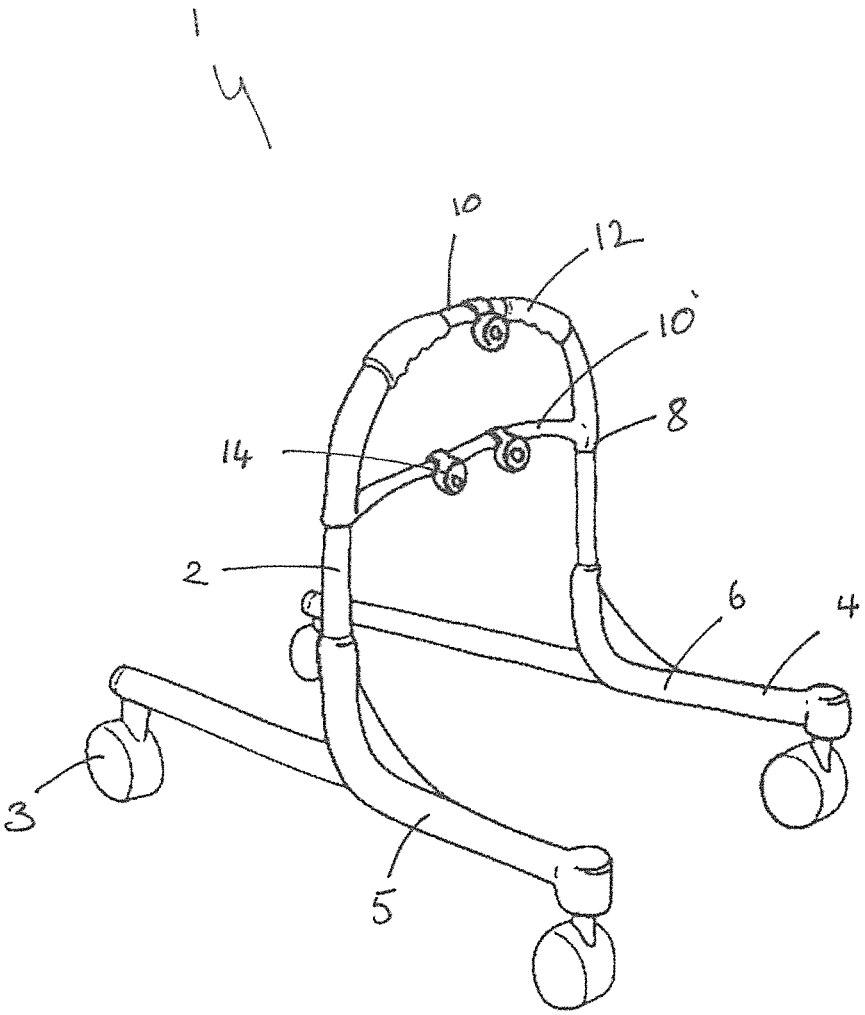
FIG. 1 is a front perspective view of a walking support apparatus embodying one aspect of the present invention.
Figure 2:
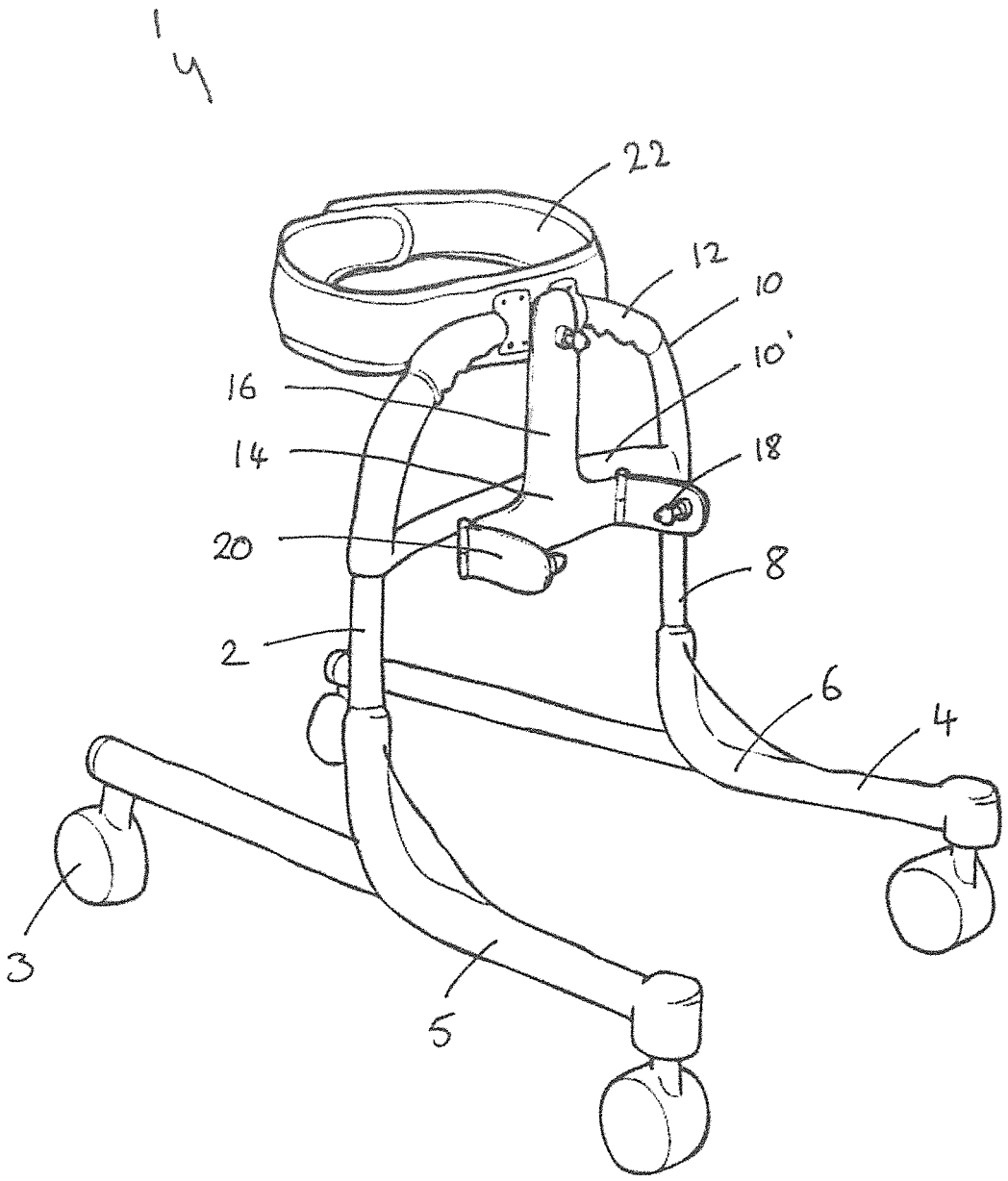
FIG. 2 is a perspective view of the walking support apparatus of FIG. 1 showing alternative attachment means.

Referring now to FIGS. 1 and 2 of the drawings, there is shown, generally indicated as 1, a walking support apparatus embodying an aspect of the invention. The support apparatus 1 comprises a frame structure 2, which is typically mounted on a plurality of wheels 3. In a preferred embodiment the wheels 3 are pivotably mounted upon the frame structure such that the wheels are multi-directional. The wheels 3 are ground-engaging and facilitate movement of the support apparatus 1 in any direction desired by the user in-use. In preferred embodiments therefore, the frame structure 2 is a self-propelled wheeled structure. The frame structure typically comprises a base 4, which carries the wheels when present, and an upper portion 8. In use, one or more users (not shown in FIGS. 1 and 2) are connected to the upper portion 8 as is described in more detail hereinafter. Accordingly, the upper portion 8 is configured, e.g. shaped and dimensioned, for connection with one or more upright (i.e. standing or walking) user.

Figure 8:
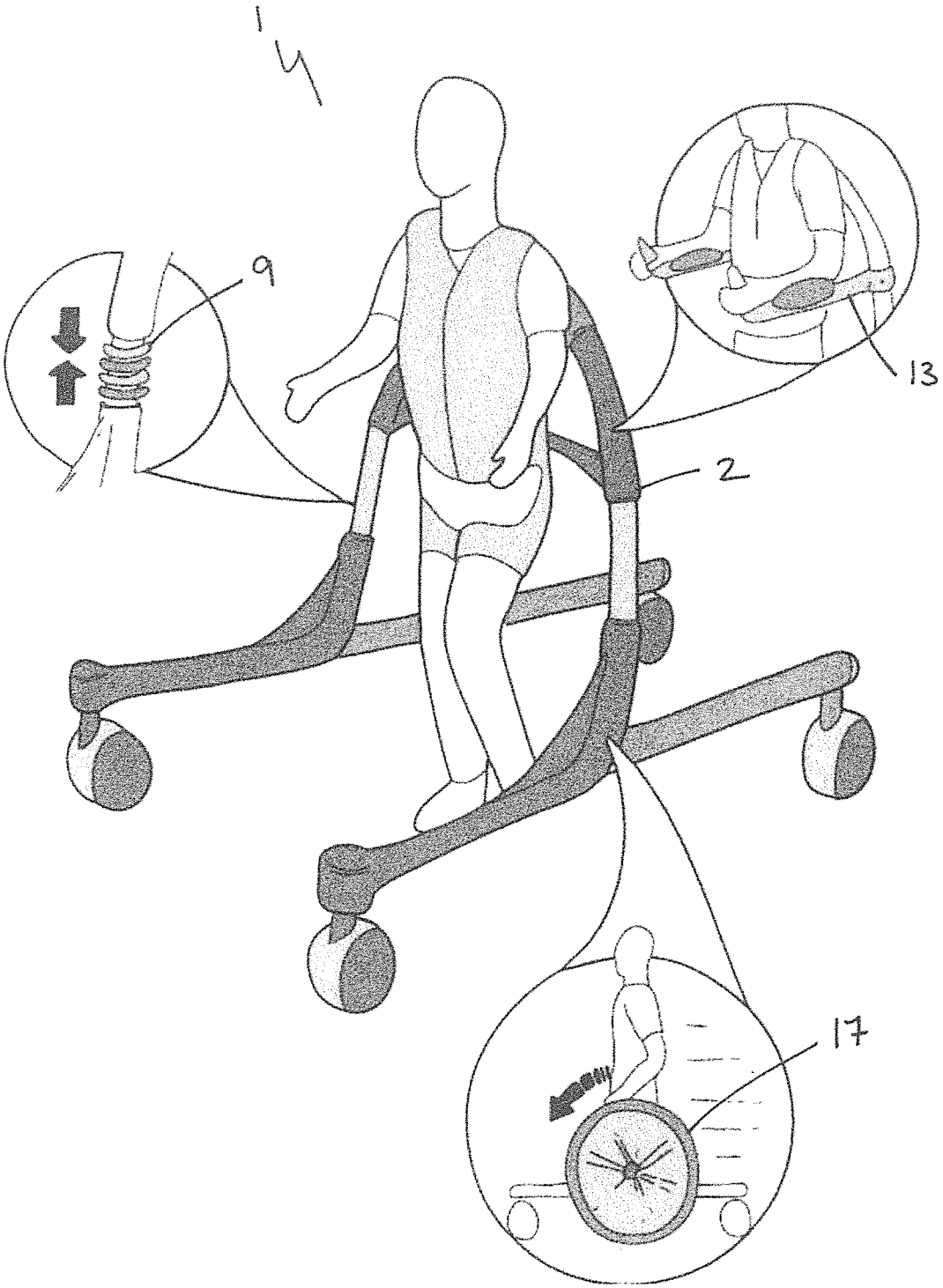
FIG. 8 is a perspective view of the walking support apparatus of previous figures with alternative embodiments shown.
Figure 9:
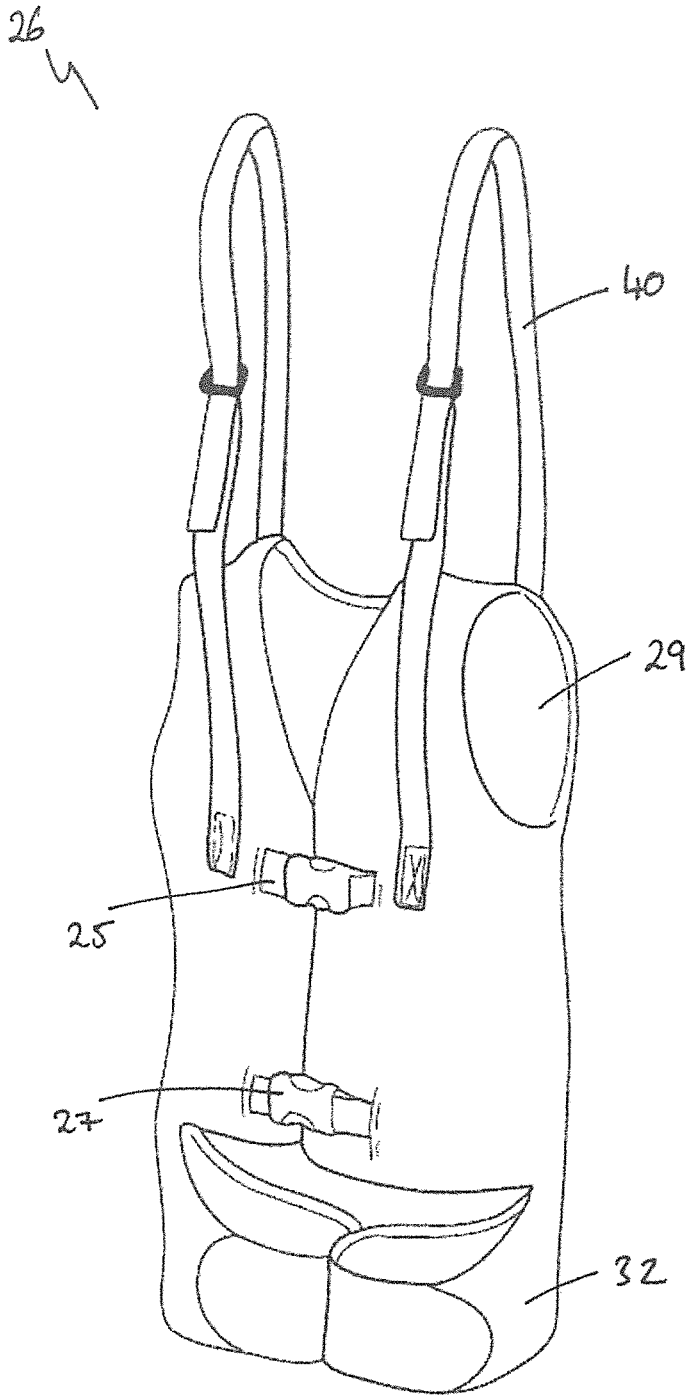
FIG. 9 is a front perspective view of the support harness with hoist straps.
Figure 10:
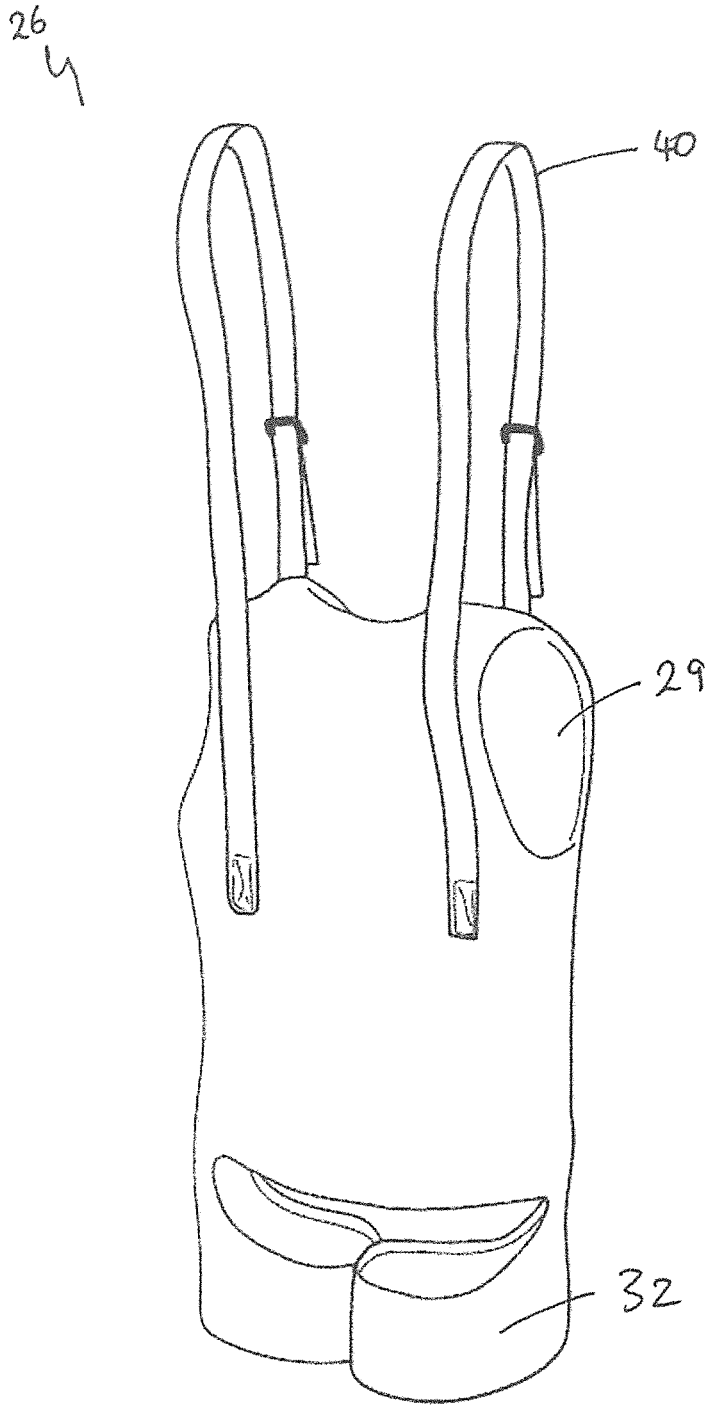
FIG. 10 is a rear perspective view of the support harness with hoist straps.

Typically the base 4 and upper portion 8 comprise a plurality of sections which are coupleable together; these sections may be pivotably coupled together such as to allow the frame structure of the support apparatus 1 to be foldable/collapsible in-use. A connecting portion between the upper portion 8 and the base 4 may comprise one or more telescopic struts (not shown) such as to allow variation in the height of the upper portion 8 relative to the base 4 in-use. The upper portion 8 may be coupled to the base 4 via a resilient biasing means 9, for example as shown in FIG. 8, the resilient biasing means may comprise at least one spring or gas strut or any other suitable biasing means. Advantageously, the incorporation of a resilient biasing means 9 allows for a margin of displacement of the upper portion 8 relative to the base 4. In an alternative embodiment the base 4 and upper portion 8 may be made from a single piece and/or otherwise rigidly fixed together.

The base 4 typically comprises first and second side members 5, 6 which extend in a spaced apart arrangement substantially parallel to each other. The first and second sides 5, 6 are coupled via the upper portion 8. The upper portion 8 typically extends transversely between the first and second sides 5, 6, and may be substantially perpendicular to the first and second sides 5, 6. An elongate channel is typically defined between the first and second sides 5, 6 of the frame structure, the channel being shaped and dimensioned to accommodate at least one user. In preferred embodiments, a respective front and rear channel are defined in front of and behind, respectively, the upper portion 8, each channel being shaped and dimensioned to accommodate a respective user. The upper portion 8, or at least part of it, is positioned for connection to a respective user in the, or each, adjacent channel. Advantageously, the or each elongate channel is open-ended to allow for easy entry and exit for the user. In an alternative embodiment end members (not shown) may extend between opposing ends of both the first and second sides 5, 6 substantially perpendicular to the first and second sides 5, 6 such as to define a substantially square or rectangular base. Alternatively, an end member may extend between the first and second sides 5, 6 at one end only, such as to define an open-ended substantially square or rectangular base.

Figure 4:
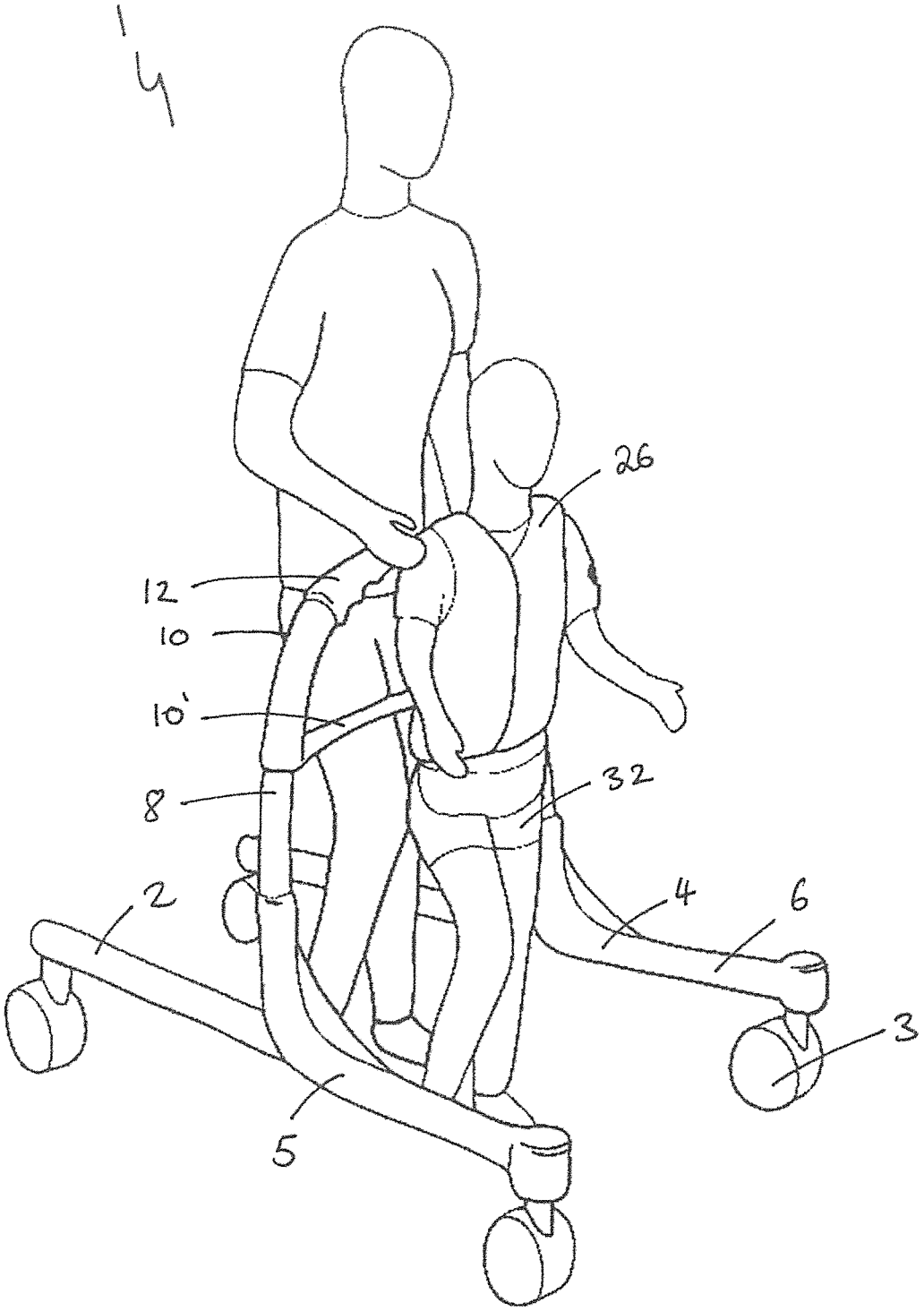
FIG. 4 is a perspective view of the walking support apparatus of previous figures showing primary and secondary users coupled to the front and rear of the apparatus respectively.

With reference in particular to FIG. 4, the primary user is the user in need of walking assistance and is accommodated by the front channel, while the secondary user provides help to the primary user and is accommodated by the rear channel. In some embodiment, the primary user is connected to the upper portion 8 during use. The secondary user may be connected, in use, to the upper portion 8 and/or to the primary user as is described in more detail hereinafter.

It will be apparent from the foregoing that, in preferred embodiments, the frame structure 2 is configured, i.e. shaped and dimensioned, to define a first station(s) for receiving the primary user and a second station for receiving the secondary user, each station being configured to accommodate the respective user in an upright state, e.g. walking or standing, on a ground surface across which it is desired to move. To this end, the base 4 is open in the region of the stations to allow the primary and secondary users to walk or stand on the ground. The stations are provided on opposite sides of the upper portion 8 (or at least opposite sides of the transversely extending portions of the upper portion 8) with respect to a longitudinal axis of the apparatus 1. This allows the secondary user to be located behind the primary user during typical use. For reasons of stability, it is preferred that the first station is provided between the first and second sides 5, 6 of the frame 2, which extend in the longitudinal direction. It is also preferred that the second station is provided between the first and second sides 5, 6 of the frame 2. To this end, the upper portion 8 (or at least the transversely extending portions of the upper portion 8) are preferably located between the ends of the sides 5, 6, e.g., substantially at the mid-point of the sides.

The upper portion 8 typically comprises an inverted U or substantially arcuate shape however it may also comprise a substantially square or rectangular shape or any other suitable shape. Typically, the frame 2 is made from any combination of, or at least one of: metal; plastic; or composite material such as carbon fibre; or any other suitable material. The wheels 3 are typically mounted on the base 4, typically on the underside of the base 4. In a preferred embodiment the wheels 3 are mounted upon opposing ends of the underside of both the first and second sides 5, 6 of the base 4. In a preferred embodiment the wheels 3 have a braking arrangement (not shown). Typically the braking arrangement may comprise a frictional brake mounted upon each of, or at least one of, the plurality of wheels 3. In an alternative embodiment, the braking arrangement may be controllable via at least one actuator (not shown) mounted upon the upper portion 8. Advantageously this arrangement allows a secondary user to control the braking arrangement in-use.

One or more cross members 10, 10' may be included in the upper portion 8. Typically the cross members 10, 10' extend transversely between the first and second sides 5, 6. In a preferred embodiment, the upper portion 8 couples the first and second sides 5, 6 to each other. The upper portion 8 typically incorporates at least one handle portion 12, e.g. provided on one or more of the cross members 10, 10'. In an alternative embodiment (see FIG. 8) the upper portion 8 may have at least one support arm 13 projecting in a forward direction and being positioned to support the or each arm (and/or hand) of a user located in the front channel. Preferably spaced apart support arms 13 are provided, one at each side of the upper portion for a respective one of the user's arms. Typically the, or each, support arm 13 extends in a substantially perpendicular direction the upper portion 8.

Figure 20:
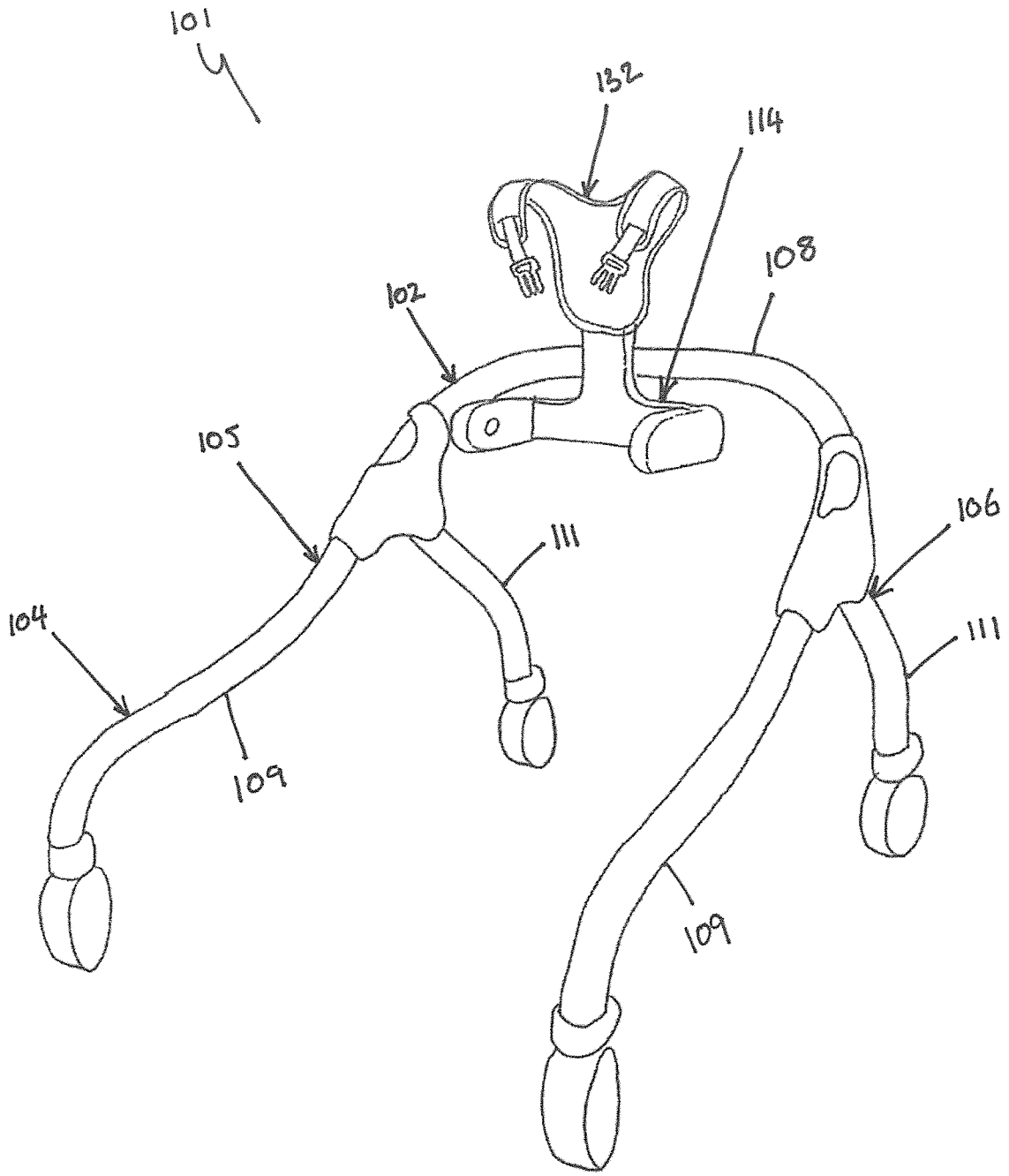
FIG. 20 is a front perspective view of an alternative embodiment of the walking apparatus with the apparatus attachment means provided thereon.
Figure 21:
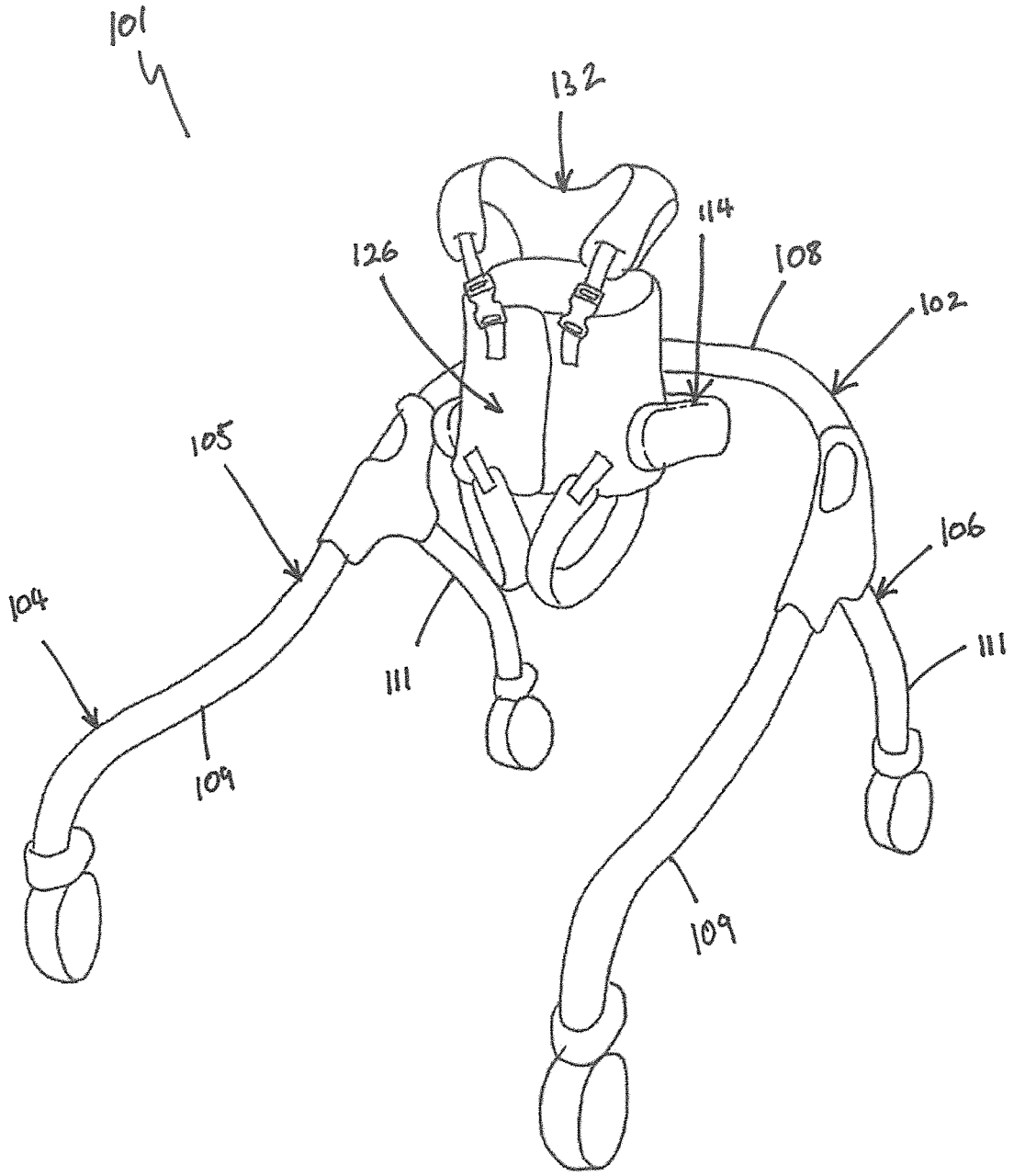
FIG. 21 is a front perspective view of the alternative embodiment of the walking apparatus showing the alternative embodiment of the support harness coupled thereon by the attachment means.
Figure 22:
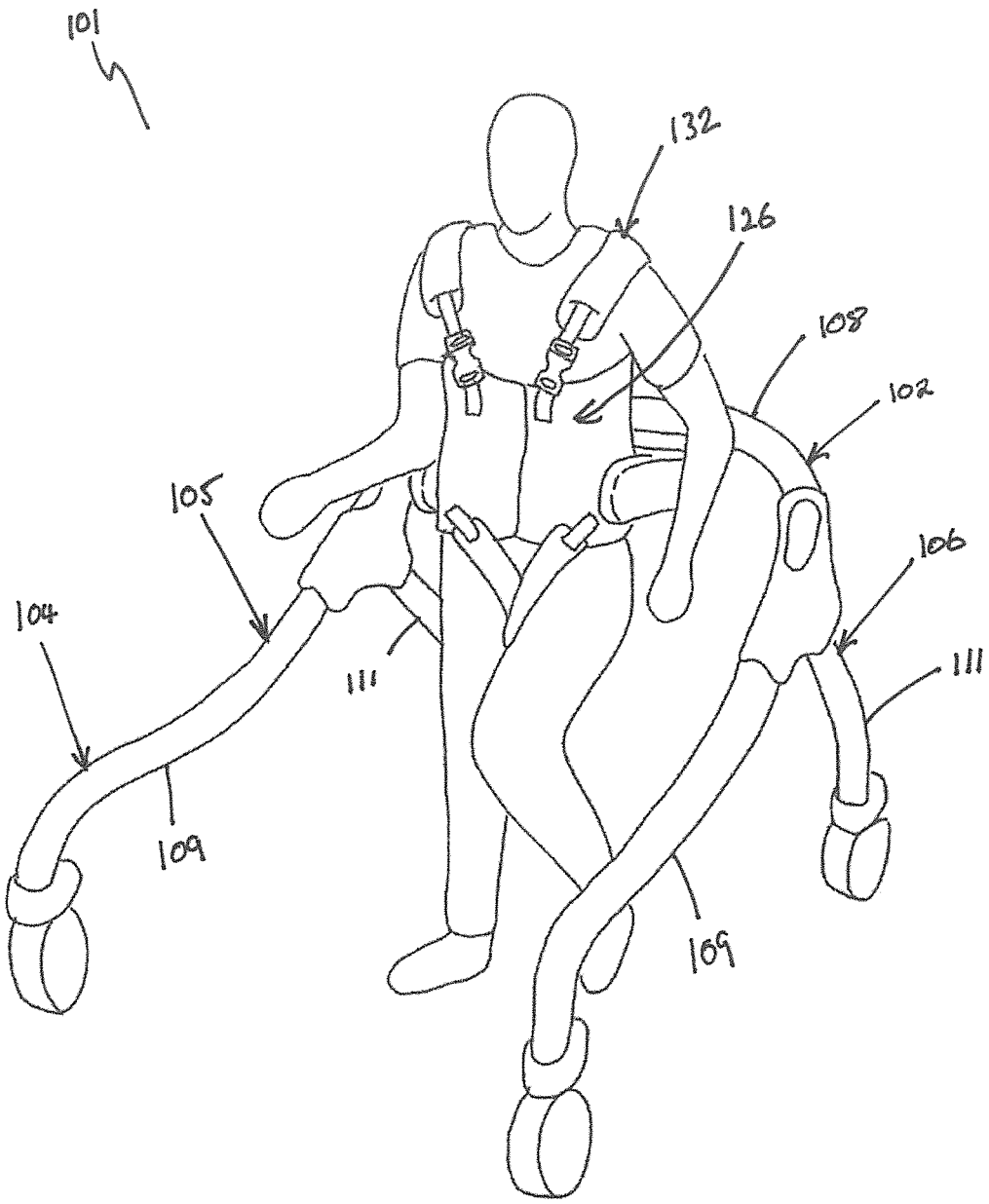
FIG. 22 is a front perspective view of the alternative embodiment of the walking apparatus showing a user coupled to the alternative embodiment of the walking apparatus.

An alternative embodiment of the support apparatus is shown in FIGS. 20 to 22, generally indicated by the reference numeral 101, and in which like numerals are used to denote like parts and in respect of which the same or similar description applies, as would be apparent to a skilled person, as is provided in relation to the support apparatus 1 unless otherwise indicated. The frame structure 102 comprises an upper portion 108 having a plurality of base legs 104 which carry the wheels when present. The wheels are preferably multi-directional wheels and are provided at the ends of the base legs 104 such that they are ground-engaging and facilitate movement of the support apparatus 101 in any direction desired by the user in-use. In use, at least one user (shown in FIG. 22) is connected to the upper portion 108 as is described in more detail hereinafter. The upper portion 108 is configured, e.g. shaped and dimensioned, for connection with the one or more upright (i.e. standing or walking) users (not shown). The upper portion 108 and base legs 104 may comprise a singular piece and/or may be otherwise rigidly fixed together. Alternatively the upper portion 108 and base legs 104 may comprise a plurality of sections which are coupleable together. The upper portion 108 may be telescopically arranged with respect to the base legs 104 such that the upper portion may be extendable in-use such as to vary the height of the upper portion 108 relative to the base legs 104. Advantageously, this arrangement allows the walking support apparatus 101 to accommodate users of varying height. The upper portion 108 may be coupled to the base legs 104 via one or more resilient biasing means 109, which may comprise at least one spring or gas strut or any other suitable biasing means. Advantageously, the incorporation of a resilient biasing means 109 allows for a margin of displacement of the upper portion 108 relative to the base legs 104.

The base legs 104 typically comprise four legs which may be substantially arcuate or bow-shaped and which extend, in first and second spaced apart pairs 105, 106 from opposite ends of the upper portion 108. The pairs 105, 106 typically extend in a bidirectional arrangement, from the respective ends of the upper portion 108. The pairs 105, 106 comprise a first leg 109 which extends in one direction and a second leg 111 which extends in the opposing direction, i.e. typically in forward and rear directions. The first leg 109 is typically longer than the second leg 111. Forward direction is to be understood as the direction in which the primary user faces, moves, when coupled to the support apparatus 101 in-use with the rear direction being the opposite direction. The base legs 104 are coupled by the upper portion 108 which typically extends, transversely between the pairs 105, 106, and may be substantially perpendicular to the first and second pairs 105, 106.

An elongate channel is typically defined between the first and second pairs 105, 106 of the frame structure 102, the channel being shaped and dimensioned to accommodate at least one user. In preferred embodiments, a respective front and rear channel are defined in front of and behind, respectively, the upper portion 108, each channel being shaped and dimensioned to accommodate a respective user. The upper portion 108, or at least part of it, is positioned for connection to a respective user in the, or each, adjacent channel. Advantageously, the or each elongate channel is open-ended to allow for easy entry and exit for the user. In an alternative embodiment end members (not shown) may extend between opposing ends of both the first and second pairs 105, 106 substantially perpendicular to the first and second pairs 105, 106. Alternatively, an end member may extend between the first and second pairs 105, 106 at one end only, such as to define an open ended frame 102.

With reference in particular to FIG. 22, the primary user is the user in need of walking assistance and is accommodated by the front channel, whilst a secondary user (not shown) may provide help to the primary user and is accommodated by the rear channel. The primary user is preferably connected to the upper portion 108 during use. The secondary user may be connected, in use, to the upper portion 8 and/or to the primary user.

Figure 5:
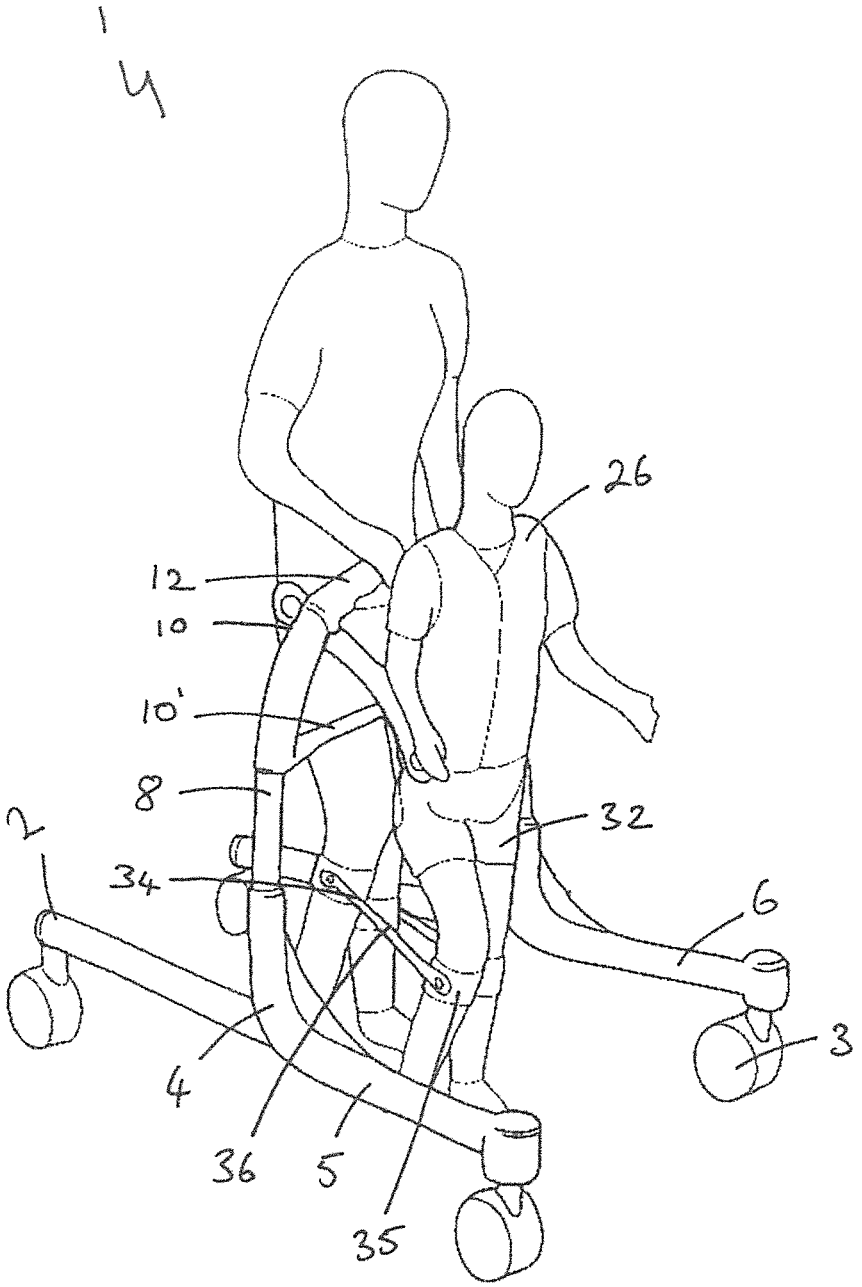
FIG. 5 is a perspective view of the walking apparatus of previous figures showing a primary user coupled to the apparatus, with a secondary user also being coupled to the primary user and/or walking apparatus.
Figure 6:
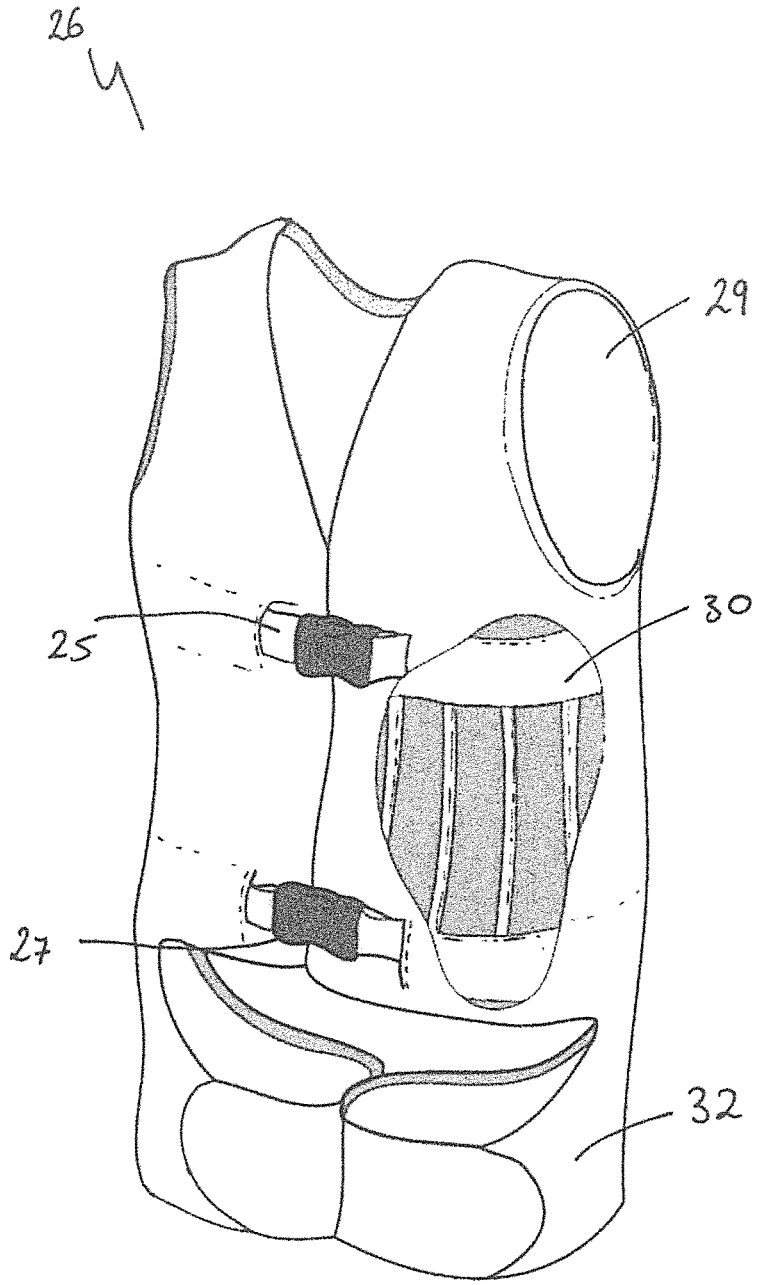
FIG. 6 is a front perspective view of a support harness embodying another aspect of the invention and suitable for use with the walking support apparatus.
Figure 7:
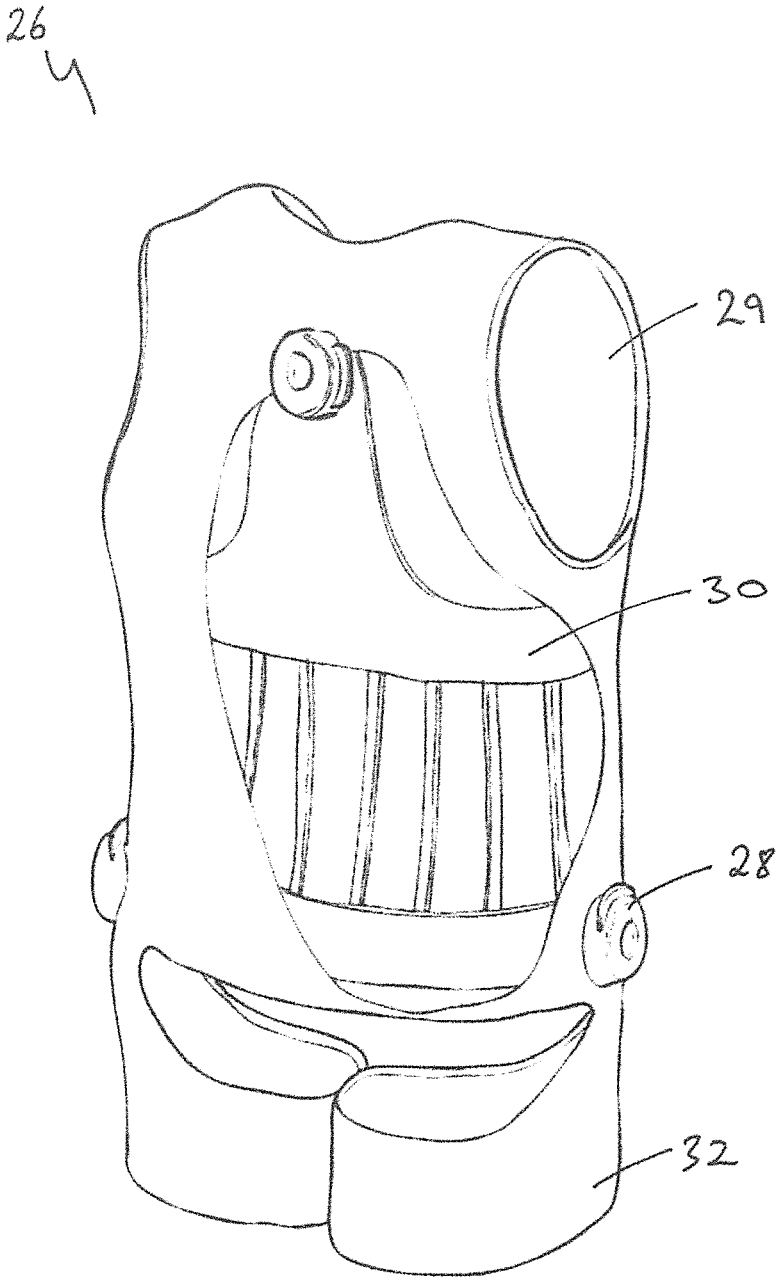
FIG. 7 is a rear perspective view of the support harness.

In a preferred embodiment the support apparatus 1, 101 comprises means for receiving and supporting the primary user as shown in FIGS. 3 to 11 and 20 to 22 and in particular FIGS. 6, 7 and 22. Advantageously, the means for receiving and supporting a primary user fully supports the user's weight when the user is inserted into the support apparatus 1, 101. The means for receiving and supporting the primary user may comprise a structural element or seat or any other suitable receiving means. The structural element may comprise a cross member (not shown) which extends transverse the first and second sides 5 and 6 or first and second pairs 105, 106 upon which the user may sit in-use.

In the illustrated embodiments, the means for receiving and supporting the primary user comprises a harness 26. The harness 26 typically comprises a flexible material such as fabric and/or a composite material however it may alternatively comprise any other suitable material. The harness 26 typically comprises a substantially waistcoat like garment, which in a preferred embodiment has open shoulder portions 29 to allow for easy access and removal. In an alternative embodiment the harness may comprise a substantially vest or life jacket garment where it can be donned by placing the item over the user's head. The harness 26 is typically secured upon the primary user via a plurality of straps and/or clasps 25, 27. Advantageously, the straps and clasps 25, 27 are adjustable such as to allow for adjustment to accommodate primary users of various dimensions.

Figure 13:
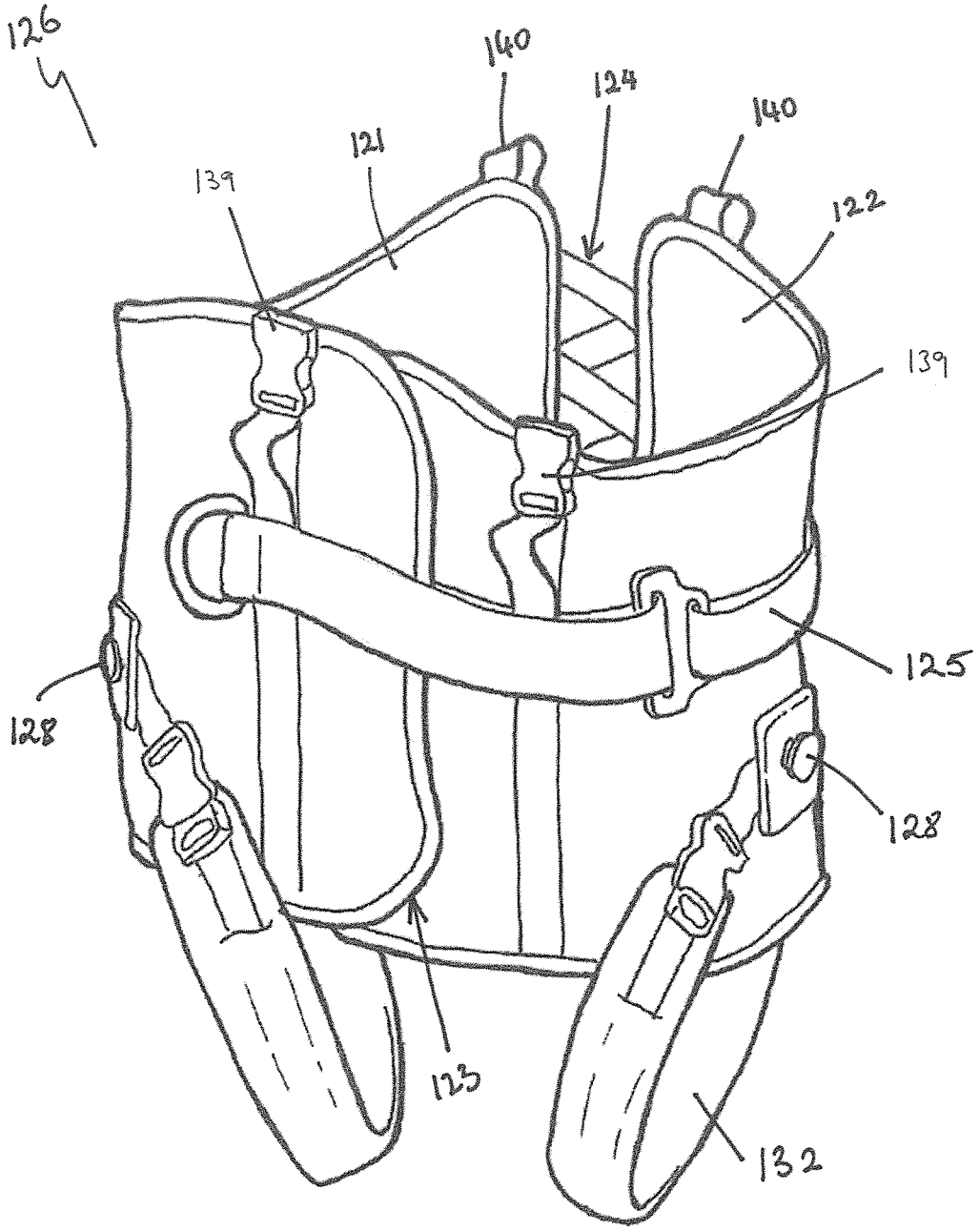
FIG. 13 is a front perspective view of an alternative embodiment of the support harness.
Figure 14:
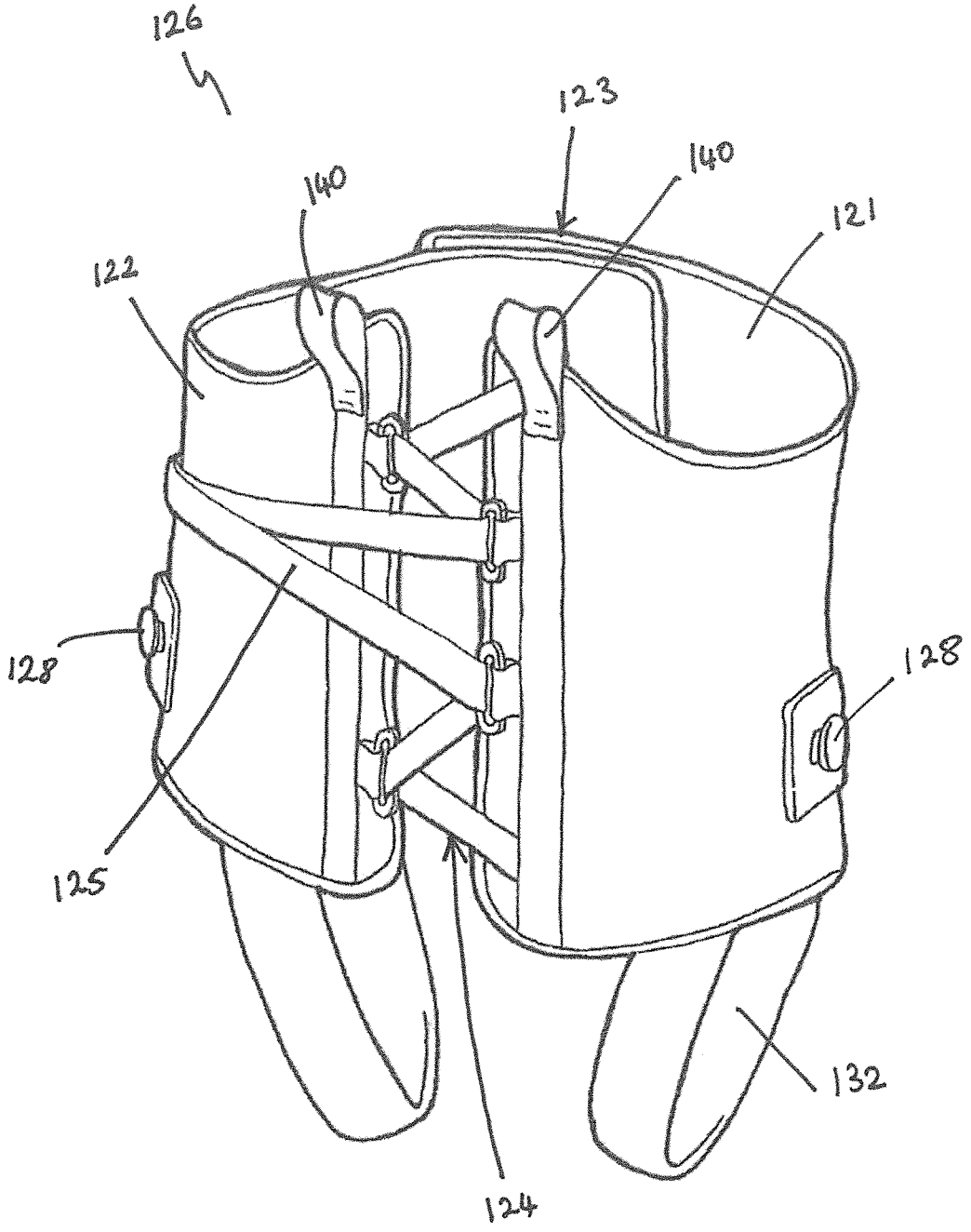
FIG. 14 is a rear perspective view of the alternative embodiment of the support harness.

An alternative embodiment of the harness is shown in FIGS. 13 to 17, generally indicated by the reference numeral 126, and in which like numerals are used to denote like parts and in respect of which the same or similar description applies, as would be apparent to a skilled person, as is provided in relation to the harness 26 unless otherwise indicated. The harness 126 is typically made from a flexible material such as fabric and/or a composite material however it may alternatively comprise any other suitable material. The harness 126 may be formed as a unit however it preferably comprises first and second portions 121, 122 which are coupleable together at opposing front and rear sides, as shown in FIGS. 13 and 14 respectively, preferably to define a substantially tubular garment. The first and second portions 121, 122 are coupled together at one side, typically the front side, by a releasable coupling 123 and at the opposing side, typically the rear side, by a fastening arrangement 124. The releasable coupling 123 is configurable between open and closed states to allow the harness 126 to be easily placed upon a user. Alternatively the harness may be donned by being placed over the user's head. The releasable coupling 123 typically comprises a hook and loop coupling however it may alternatively comprise any suitable co-operating coupling arrangement such as plug and socket, belt and buckle and/or any other convenient male and female coupling. The fastening arrangement 124 is configured to tighten or loosen the harness 126 such as to accommodate users of varying dimension. Advantageously the adjustability of the fastening arrangement 124 allows the harness 126 to be loosened such that it may easily pass over a user's head when being donned in this manner, being tightened thereafter in-use. The fastening arrangement 124 typically comprises a strap 125 which extends, in a substantially criss-cross manner, between the first and second portions 121, 122, wherein a portion of the strap 125 extends around, at least part of, the circumference of the harness 126, typically from the rear to the front of the harness 126 such as to provide means by which the fastening arrangement 124 may be tightened or loosened when the harness 126 is upon the primary user. The harness 126 ideally extends around the users midriff in-use.

The harness 26, 126 typically incorporates a postural support structure 30 configured, e.g. shaped and dimensioned, to provide postural support to the primary user. The postural support structure 30 may comprise a single piece or a plurality of different postural support members. The postural support member(s) 30 may comprise rigid or semi-rigid structures. Typically the postural support members 30 are insertable and removable into and from the harness 26, 126. Typically the postural support members 30 extend in a vertical and/or horizontal direction within the harness 26, 126. Advantageously, the postural support member(s) 30 is/are easily removed and interchanged enabling them to be customised as per the user's requirements with postural support members 30 of different sizes, materials and/or flexibility. In preferred embodiments, the postural support structure 30 comprises a rib like structure which extends substantially around the circumference of the user's torso in use. In an alternative embodiment the harness 26, 126 may incorporate a postural support structure moulded to the user's dimensions. The postural support structure 30 may comprise any combination of, or at least one of: metal; plastic; or composite material such as carbon fibre; or any other suitable material.

The harness 26, 126 is configured to be worn on one or more body parts of the primary user. In a preferred embodiment the harness 26, 126 is worn on the torso of the user, additionally it may also comprise one or more thigh straps 32, 132 and/or leg and/or arm straps (not shown). In a preferred embodiment the thigh straps 32 may be secured around the user's thigh via releasable connectors such as hook and loop fasteners such as e.g. Velcro® or alternatively via plug and socket connector parts, belt and buckle connector parts and/or any other convenient cooperating male and female connector parts and/or magnetic connector parts. Advantageously, the thigh straps 32, 132 help to prevent scissoring of the primary user's legs in-use.

Optionally, the harness 26, 126 is permanently coupled to the frame structure 2, 102. In such embodiments the primary user may be insertable into and out of the harness 26, 126 for coupling to the support apparatus 1, 101. In alternative embodiments the harness 26, 126 may be removably coupled to the frame structure 2, 102. In such embodiments the harness 26, 126 has a harness attachment means 28, 128 which can be releasably connected to corresponding apparatus attachment means 14, 114 provided on the support apparatus 1, 101 typically on the upper portion 8, 108. The attachment means 14, 114, 28, 128 may comprise one or more releasable, corresponding connector parts which together provide one or more releasable connectors, one part 28, 128 of each connector being provided on the harness 26, 126 and the respective corresponding other part 14, 114 being provided on the frame structure 2, 102, preferably on the upper portion 8, 108. The corresponding connector parts 14, 28 and 114, 128 may comprise any conventional releasable connector parts, e.g. plug and socket connector parts, hook and loop connector parts, belt and buckle connector parts and/or any other convenient male and female connector parts and/or magnetic connector parts.

Figure 15:
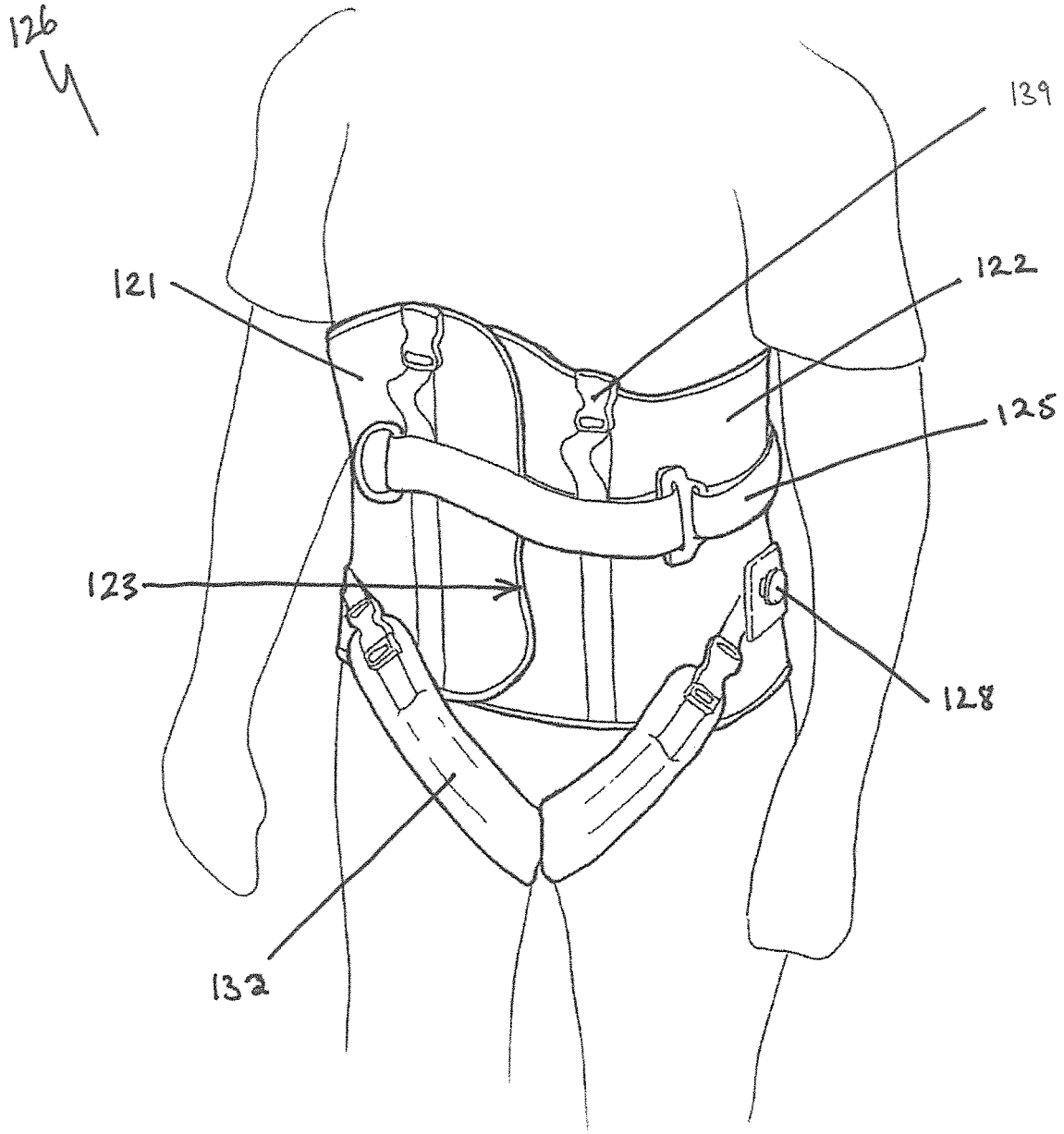
FIG. 15 is a front perspective view of the alternative embodiment of the support harness shown upon a user.

In preferred embodiments, the harness 26 has at least three harness attachment means 28, or connector parts 28, wherein at least one is located upon either side of the harness 26 (at a location corresponding to the user's side or hips) and at least one is located on the back, preferably the upper back, of the harness (preferably at a location corresponding to the user's upper back), as shown in FIG. 7. However more or fewer harness attachment means 28 may be provided upon the harness 26 as per user requirements. In an alternative embodiment as shown in FIGS. 13 to 15, the harness has two harness attachment means 128, wherein at at least one is located upon either side of the harness 126 (at a location corresponding to the user's side or hips).

Typically the apparatus attachment means 14, 114 is provided on the upper portion 8, for example on one or more of the cross members 10, 10'. The apparatus attachment means 14, 114 is configured to allow for the attachment of the primary user wearing the harness 26, 126 to the apparatus 1, 101, and to this end comprises correspondingly positioned connector parts 14, 114 for connection with the harness connector parts 28, 128.

Figure 19:
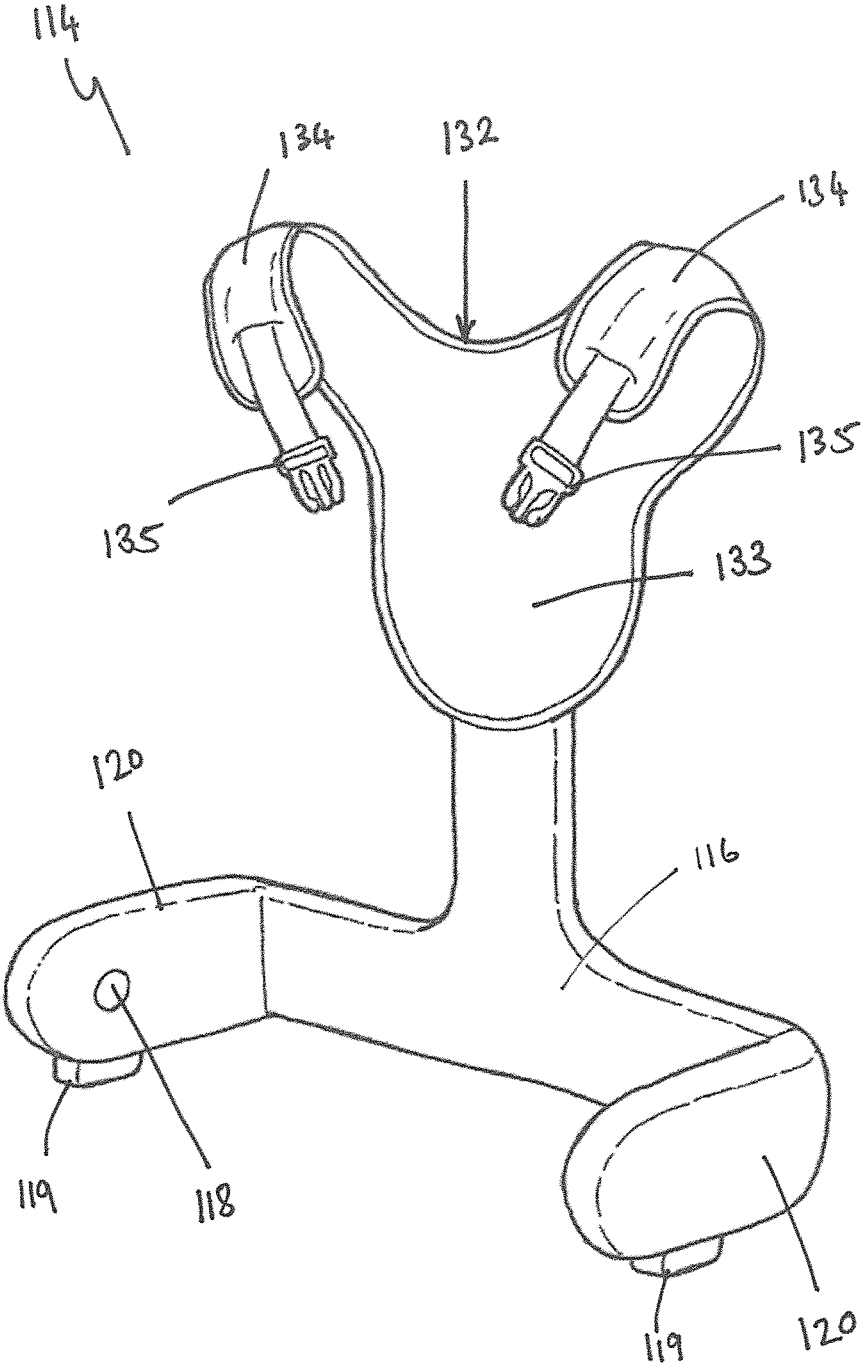
FIG. 19 is a front perspective view of an apparatus attachment means for coupling to the support harness.

In some embodiments, for example as illustrated in FIGS. 2 and 19, the apparatus attachment means 14, 114 comprises a bracket 16, 116 which has a plurality of connector parts 18, 118 for releasable connection to corresponding connector parts 28, 128 on the harness 26, 126. In a preferred embodiment the apparatus attachment means 14, 114 may comprise an inverted T shaped bracket 16, 116. Typically the bracket 16, 116 is mounted upon the upper portion 8, 108 for example on the cross member 10 or 10'. The bracket 16, 116 may comprise a lateral portion and a central longitudinal portion. The lateral portion of the bracket 16, 116 which typically extends substantially parallel to the cross member 10 and/or upper portion 108 typically comprises arms 20, 120 which may be pivotably coupled to the ends of the lateral portion of the bracket 16, 116 which extend perpendicular to the longitudinal portion, however in the alternative embodiment shown in FIG. 19 the arms 120 are fixedly coupled. Typically at least one connector part 18, 118 is provided on each of the arms 20, 120 of the lateral portion, as shown in FIG. 2 another connector part 118 may be provided on the top end of the central longitudinal portion. Advantageously, the pivotably coupled arms 20 allow for the connectors 18 of the apparatus attachment means 14 to pivot towards or away from the primary user to allow for easy access or removal of the user from the apparatus in-use. In the alternative embodiment shown in FIG. 19 the connector part 118 is incorporated within the arms 120 with the connector part 118 being movable between extended and retracted states preferably by an actuator (not visible), which is typically resiliently biased to urge the connector part 118 into its extended state. In the extended state the connector part 118 is exposed for connection to a corresponding connector part (not shown in FIG. 19). A button 119, or other operating device, is provided for operating, in this case releasing, the actuator to move the connector part 118. Advantageously, the connector part 118 is movable between extended and retracted states such that the harness 126 may be easily releasably coupled to the apparatus attachment means 114. In an alternative embodiment, the connectors 18 of the apparatus attachment means 14 may be mounted directly upon the upper portion 8 and/or cross member 10, 10' as shown in FIG. 1. The connectors 18, 118 typically comprise male or female formations such as to form a releasable connection with a corresponding female or male formation 28, 128 provided on the harness 26, 126. The connector parts 18, 118 may for example comprise: snap or magnetic connectors or any other suitable quick release connector component.

In the alternative embodiment shown in FIG. 19, the bracket 116 has a shoulder support 132 provided at the top end of the central longitudinal portion. The shoulder support 132 is configured to support the upper body of the primary user when coupled to the support apparatus 101 in-use. The shoulder support 132 typically formed from a flexible material such as fabric and/or a composite material however it may alternatively comprise any other suitable material. The shoulder support 132 typically comprises a main portion 133, which is coupled to the central longitudinal portion of the bracket 116 and at least two branch portions 134 which extend from the body of the main portion 133, which are configured to wrap around the primary user's shoulders in-use. A shoulder coupling arrangement 135 is typically provided at the ends of the branch portions 134. The shoulder coupling arrangement 135 can be releasably connected to a corresponding torso coupling arrangement 139 provided on the harness 126. The shoulder, torso coupling arrangements 135, 139 may comprise one or more releasable, corresponding connector parts which together provide one or more releasable connectors, one part 139 of each connector being provided on the harness 126 and the respective corresponding other part 135 being provided on the bracket 116, more specifically the shoulder support 132. The corresponding connector parts 135 and 139 may comprise any conventional releasable connector parts, e.g. plug and socket connector parts, hook and loop connector parts, belt and buckle connector parts and/or any other convenient male and female connector parts and/or magnetic connector parts.

The frame structure 2 includes auxiliary attachment means 22 for releasably connecting the secondary user to the frame 2, and in particular to the upper portion 8. Conveniently the auxiliary attachment means is provided on the upper portion 8, for example on one or both of the cross members 10, 10'. Typically the auxiliary attachment means 22 is mounted on the opposite face of the upper portion 8 and/or cross member 10 relative to the apparatus attachment means 14 as shown in FIG. 2. In a preferred embodiment the auxiliary attachment means 22 comprises at least one of, a waistband, belt harness, one or more straps. However it may alternatively comprise any other suitable releasable connecting device. For example, the auxiliary attachment means 22 may comprise one or more releasable connectors (e.g. as described above for harness and apparatus connectors), one part of each connector being provided on the frame structure 2 the other part being worn by the secondary user, e.g. on a belt, harness or other garment.

In an alternative embodiment shown in FIG. 8, the support apparatus 1 may have centrally mounted wheels 17 mounted thereon. The wheels 17 may be coupled to the base 4 and/or upper portion 8. In a preferred embodiment the wheels 3 are coupled to first and second sides 6, 8, preferably to the outward facing sides of the first and second sides 6, 8 as shown in FIG. 8. Advantageously the wheels 17 allow the user to achieve more rapid displacement of the support apparatus 1 in-use. In an alternative embodiment a seat (not shown) may be provided on the apparatus 1 to provide additional support to a user. The seat may be coupled to the upper portion 8. The seat 8 may also comprise a saddle or pommel or any other suitable support.

Figure 16:
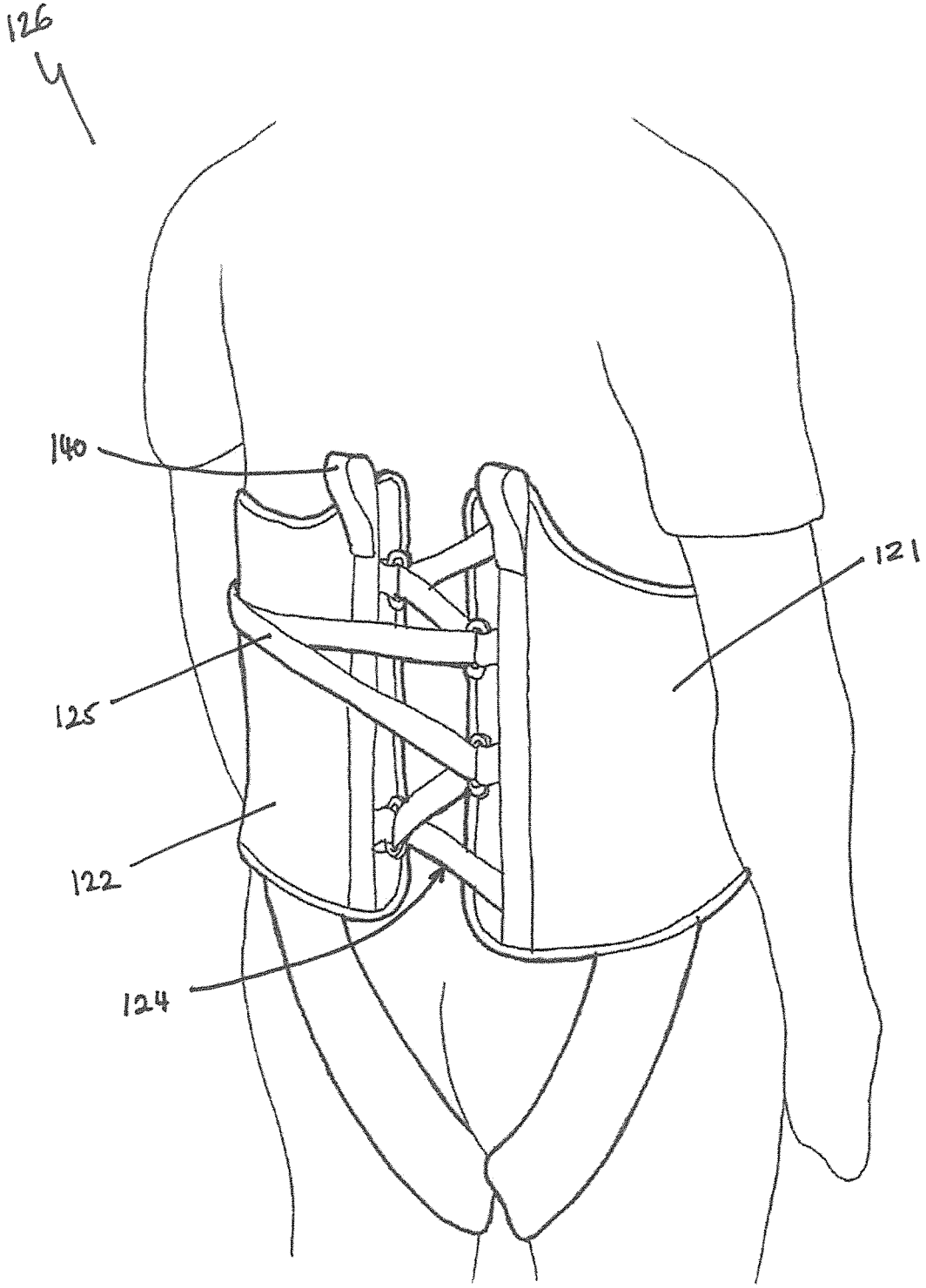
FIG. 16 is a rear perspective view of the alternative embodiment of the support harness shown upon a user.
Figure 17:
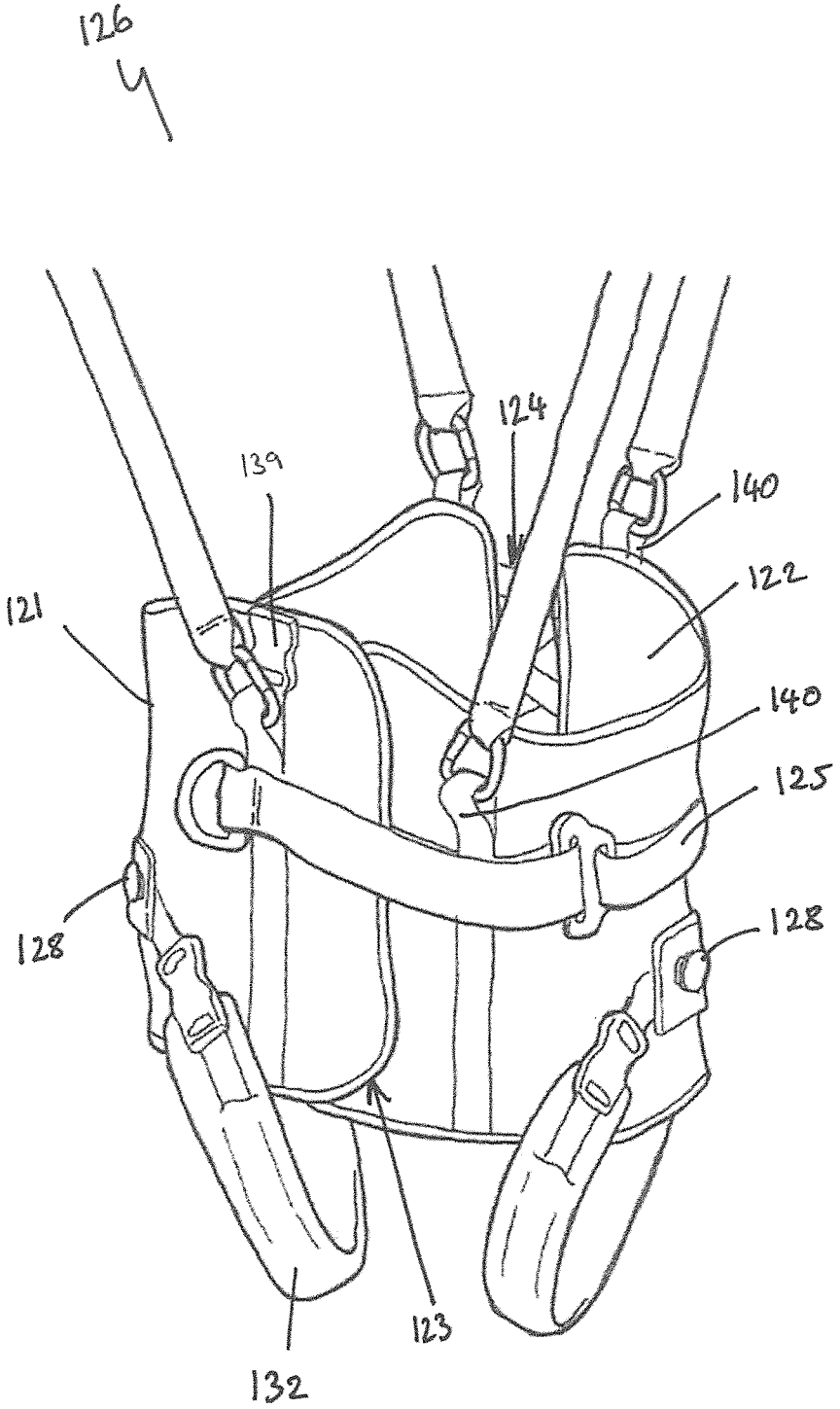
FIG. 17 is a front perspective view of the alternative embodiment of the support harness with hoist straps coupled thereto.
Figure 18:
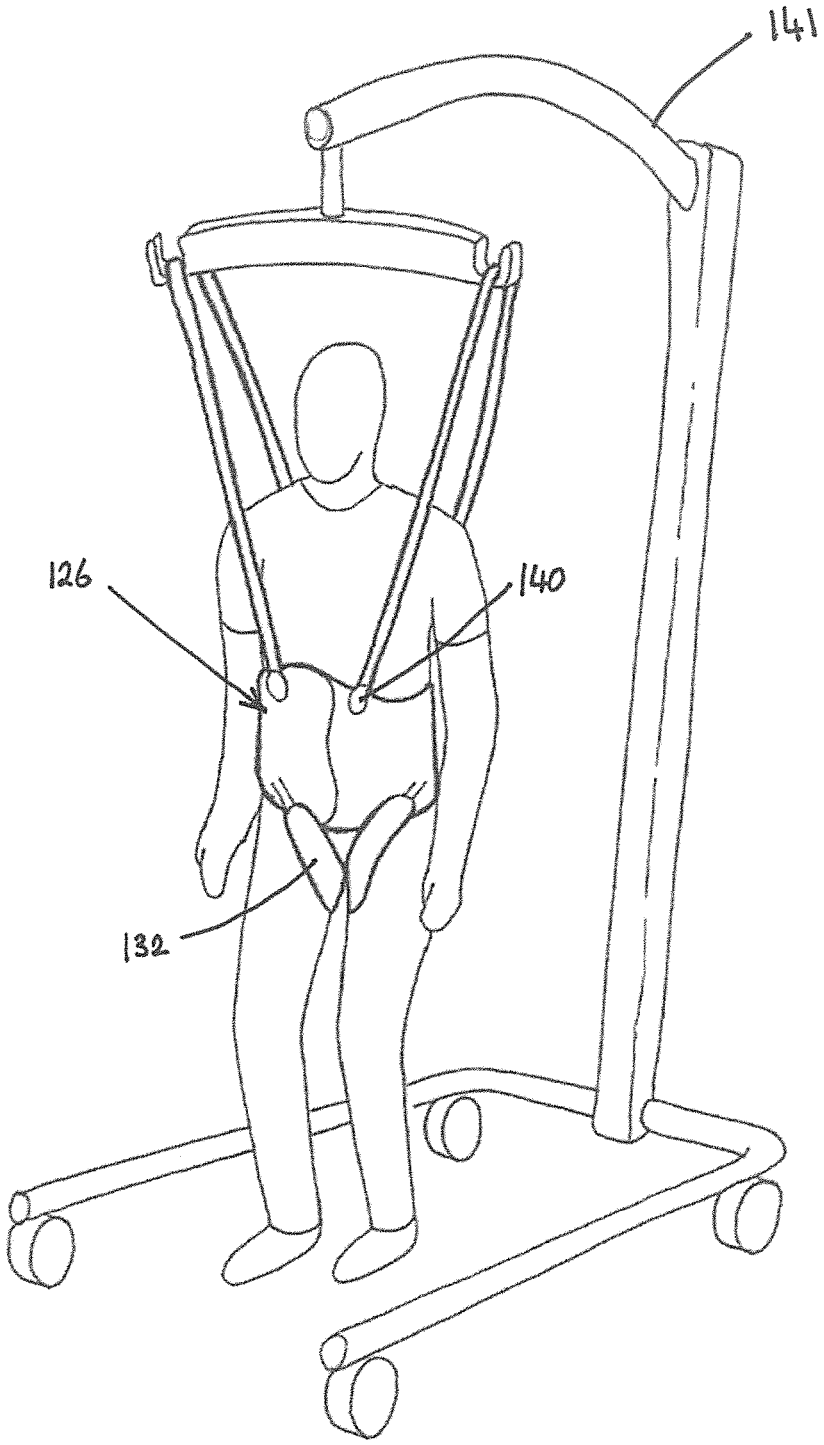
FIG. 18 is a front perspective view of the alternative embodiment of the support harness showing a user being hoisted using the hoist straps.

Advantageously, the harness 26, 126 in combination with the open frame structure of the support apparatus 1, 101 allows for the easy transfer of the primary user in/out of the support apparatus 1, 101. The open frame structure is particularly beneficial as it allows for the user to be hoisted in and out of the apparatus 1, 101. To this end it is preferred that the harness 26, 126 includes at least one hoist point 40, 140 as shown in FIGS. 9 to 11 and 16 to 18. To provide each hoist point 40, 140 the harness 26, 126 has a respective connector suitable for releasably connecting the harness 26, 126 to a hoist 41, 141. Preferably, each hoist point is located at the shoulder or upper torso region of the harness 26. For reasons of balance, it is preferred that a respective hoist point is provided on the left and right side of the harness. It is further preferred that a respective hoist point is provided on the front and back of the harness for balance. For example, in a preferred embodiment, the hoist points are provided in first and second pairs, the first pair being on the right side of the harness, the second pair being on the left side, a respective hoist point of each pair being on the front of the harness the other being on the back as is shown in FIGS. 16 to 18.

Each hoist point 40, 140 typically comprises a strap, preferably a length-adjustable strap, wherein the straps have sufficient slack such as to be able to allow the user within the harness to be hoisted from above in-use. The straps may be removably detachable from the harness 26, 126. Alternatively, each hoist point 40, 140 may comprise a ring or hook or any other suitable hoisting apparatus connector.

Figure 11:
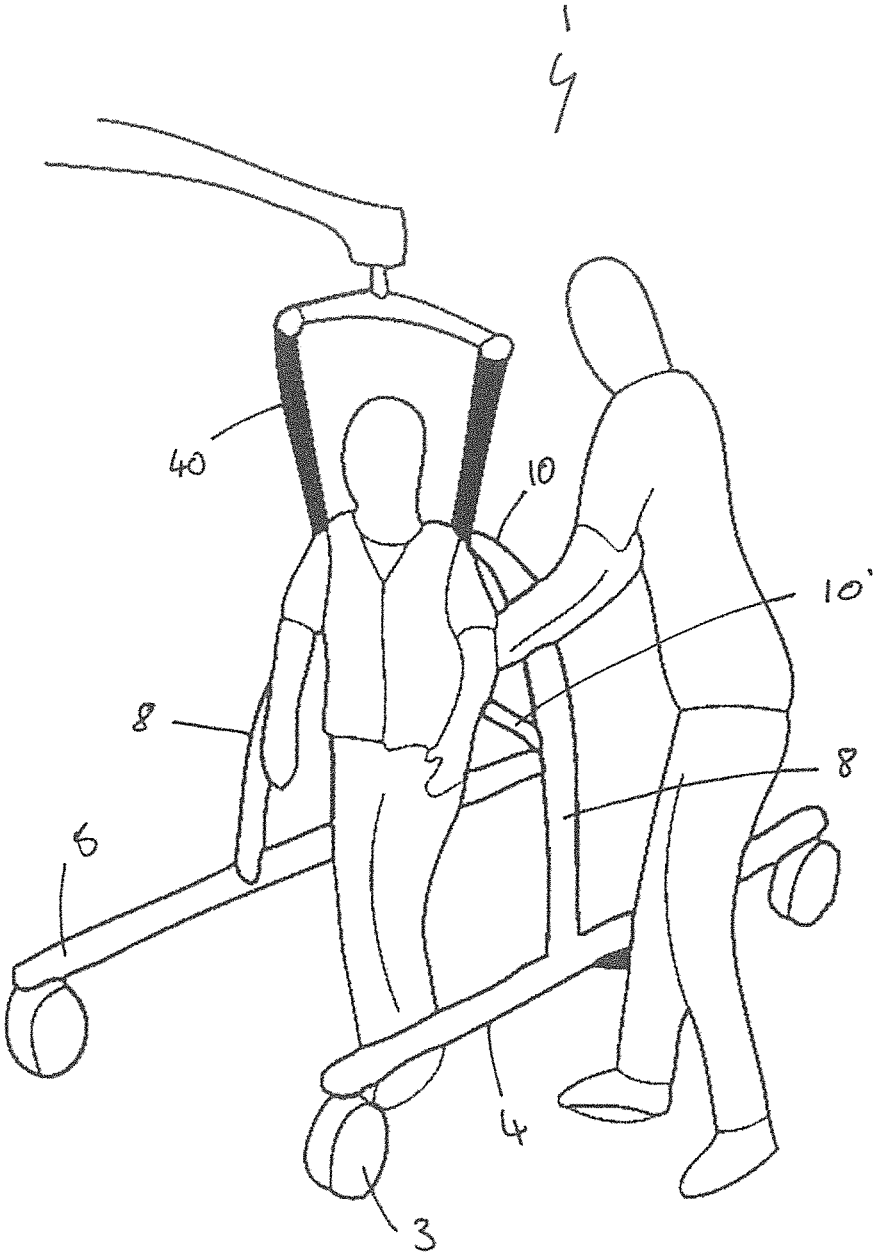
FIG. 11 is a perspective view of the walking apparatus showing a primary user being hoisted into the apparatus.
Figure 12:
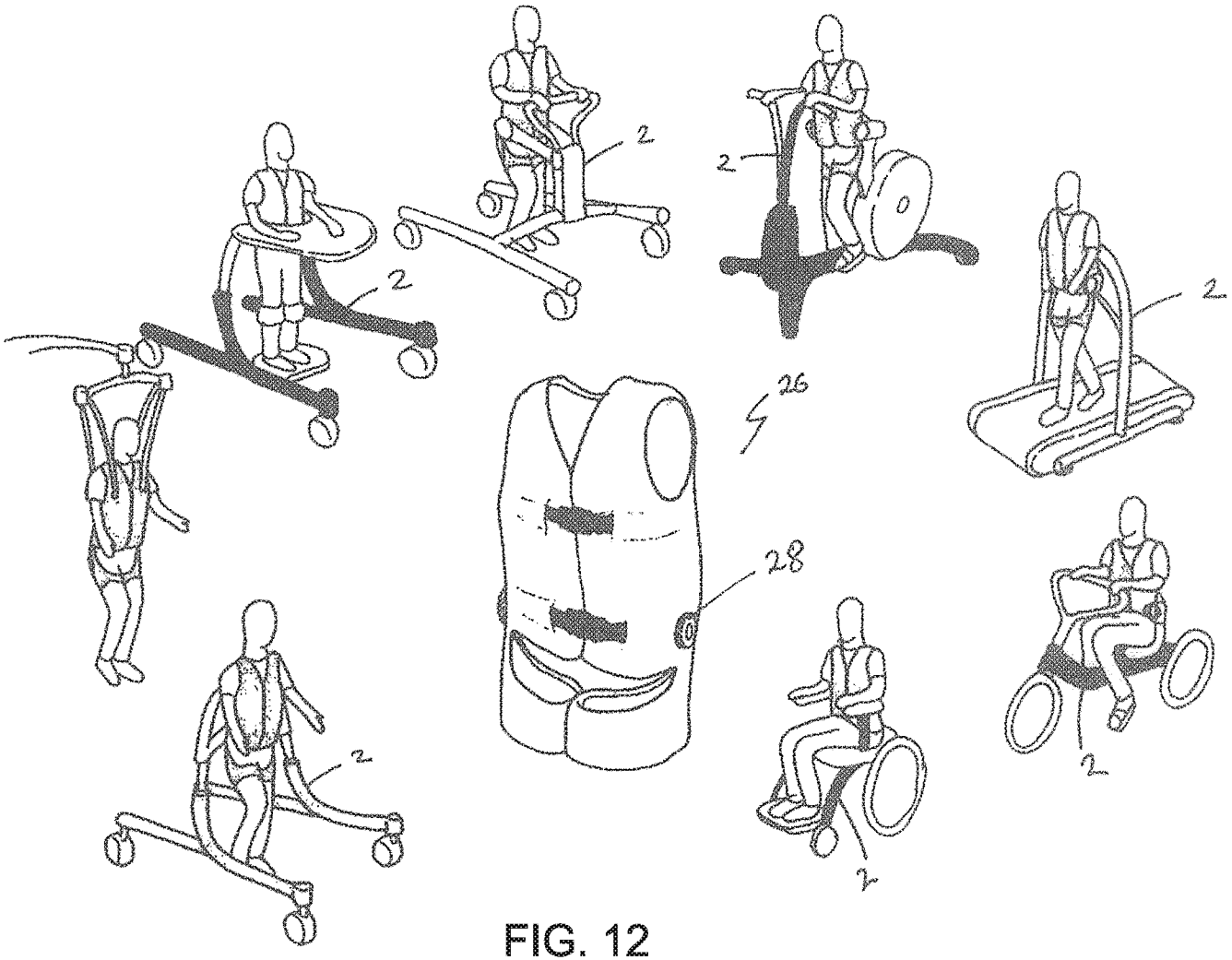
FIG. 12 shows the support harness in multiple applications.

In embodiments where the harness 26, 126 is permanently coupled to the frame structure, the user may be helped into the harness 26, 126 and support apparatus 1, 101 via the assistance of the secondary user or care assistant and secured therein. In embodiments where the harness 26, 126 is removably coupled to the frame structure, the harness 26, 126 is typically placed on the primary user prior to coupling to the support apparatus 1, 101. For example, the harness 26, 126 may be placed on the user whilst the user is in a seating system, laid down on a bed, or wherever best suits the user or situation. Once the harness 26, 126 is securely fastened to the primary user and to the hoist 41, 141 they can then be safely hoisted to a substantially upright position and supported in front of the support apparatus 1, 101 whilst the secondary user or carer fastens the harness 26, 126 to the support apparatus 1, 101 as shown in FIG. 11 via coupling of the harness attachment means 28, 128 and the apparatus attachment means 14, 114. Advantageously, this aids in making the task of transferring a user into the support apparatus 1 easier and safer for, both, the carers and user. The harness attachment means 28, 128 allows for the harness 26, 126 to be coupled to any equipment which has corresponding apparatus attachment means 14, 114. Advantageously, this allows the harness 26, 126 to be coupled to a wide range of apparatus including walkers, standing frames, seating systems and support apparatus equipment as shown in FIG. 12. This arrangement further increases the utility of the apparatus 1, 101 as it allows a user wearing the harness 26, 126 to be easily transferred between various apparatus such as those previously stated without having to remove the harness 26, 126. This is facilitated in preferred embodiments by the provision of the hoisting points 40, 140 on the harness 26, 126 which allows for the user to be hoisted between equipment.

A further advantageous feature of the support apparatus 1, 101 is that as the apparatus attachment means 14, 114 between the harness 26, 126 and support apparatus 1, 101 would be the same for multiple users, several users could have their own harness and use the same support apparatus 1, 101 as others in-use. This would potentially save schools and centres money when purchasing walking products for several users, as well as tackling the common issue of limited storage space in such places.

Figure 3:
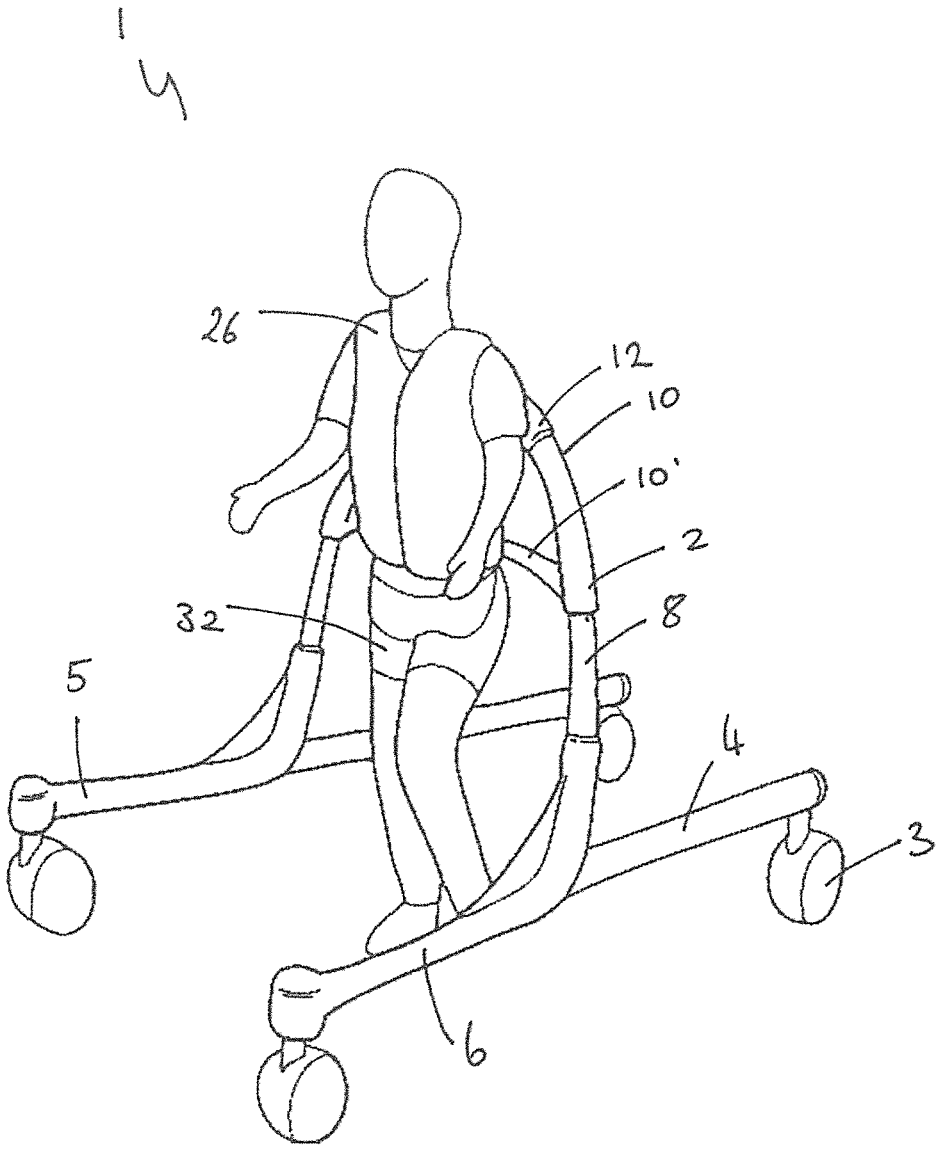
FIG. 3 is a perspective view of the walking support apparatus of FIGS. 1 and 2 showing a primary user coupled thereto.

One embodiment of the invention provides a support apparatus 1, 101 for a primary user as shown in FIGS. 3 and 8, wherein the support apparatus comprises a frame structure which has a means for receiving and supporting a primary user 26 therein. Advantageously, this arrangement supports the primary user in a substantially upright position in-use and allows the user to walk without the fear of falling in-use. Advantageously, the substantially open frame structure of the support apparatus 1 allows the primary user to interact with other persons, nearby objects and allows the primary user a greater degree of independence.

In the embodiment of FIGS. 4 and 5 the secondary user is coupled to the support apparatus 1 in conjunction with the primary user. Advantageously, this arrangement allows for the secondary user to take on the task of moving and controlling the support apparatus 1 in use. This will allow the primary user to focus their efforts on developing their own walking movements in-use. The secondary user may control the movement of the support apparatus 1 via the auxiliary attachment means 22 and/or via gripping the support apparatus 1 in-use. Typically the secondary user grips the handle portion 12 of the support apparatus 1 in-use as shown in FIG. 4. The secondary user is typically coupled via the auxiliary attachment means 22 shown in FIG. 2. Additionally, the secondary user may be removably coupled to the primary user via at least one linkage 34. Each linkage 34 may also be coupled between the harness 26 of the primary user and the auxiliary attachment means 22 of the secondary user. The linkages 34 may be coupled between one or more respective body parts of the primary and secondary users. For example, the linkages 34 may be coupled between the legs and/or hips and/or feet and/or arms or any other suitable body part. The linkages 34 may comprise one or more flexible straps 35 which are wrapped around body parts of both the primary and secondary user in use and coupled together via at least one rod 36. Typically, the flexible straps 35 may comprise a fabric or plastic or any other suitable flexible material. Typically the rod 36 may comprise a combination of, or at least one of; plastic, metal, or a composite material such as carbon fibre or any other suitable material. Advantageously, the linkages 34 allow the secondary user to assist the primary user in walking via the support frame 1, by aiding in the movement of the primary user's legs and/or hips and/or feet or any suitable body part in-use.

Further advantageously, by enabling a secondary user to guide or control the leg and hip movements of a primary user via the coupling of the body parts via the linkages 34, it is possible to help encourage a more natural gait pattern, thus preventing some of the negative effect of poor gait. It also gives the potential for the primary user to experience and understand a more normal reciprocal pattern, which they may then be able to replicate on their own. The linkages 34 also enable the secondary user to encourage leg and hip movements as part of therapy techniques to reduce muscles tone. These linkages 34 further keep the hands of both users' free for other tasks. Also, by enabling the secondary user to control the support apparatus 1 via their body, it frees up their hands for other tasks, such as supporting or controlling the primary user's movements.

The invention is not limited to the embodiment(s) described herein but can be amended or modified without departing from the scope of the present invention, which is intended to be limited only by the scope of the appended claims as interpreted according to the principles of patent law including the doctrine of equivalents.

The invention claimed is:

1. A system for coupling a user to at least one support apparatus, said system comprising:

a harness for the user;

a hoist;

wherein said harness and said hoist have a primary co-operable attachment means for releasably coupling said harness to said hoist; and at least one frame configured to receive said user, wherein said harness and said at least one frame have a secondary co-operable attachment means for releasably coupling said harness to said at least one frame;

wherein said secondary co-operable attachment means comprises co-operable harness and apparatus attachment means;

wherein said apparatus attachment means comprises a bracket which has a plurality of connector parts provided thereon, wherein said bracket is provided upon said frame;

wherein when said harness is coupled to said frame, with the user within said harness, said secondary co-operable attachment means is configured to retain said user relative to said frame such that rotational movement of said user effects generally simultaneous rotational movement of said frame.

2. The system of claim 1, wherein said at least one frame comprises at least one of a walker, standing frame, seating apparatus, and exercise apparatus for the user.

3. The system of claim 1, wherein said harness attachment means and said apparatus attachment means comprises one or more releasable, corresponding connector parts that together provide one or more releasable connectors, and wherein one part of each releasable connector being provided on the harness and the respective corresponding other part being provided on said at least one frame.

4. The system as claimed in claim 3, wherein said apparatus attachment means comprises at least one of said connector parts provided on said at least one frame, and wherein said harness attachment means comprises at least one of said connector parts provided on said harness.

5. The system of claim 4, wherein said harness attachment means comprises a plurality of said connector parts provided on said harness, wherein a respective one of said connector parts is located upon either side of the harness at a respective location corresponding to the user's side, and wherein said harness attachment means comprises a respective one of said connector parts located on the back of the harness at a location corresponding to the user's upper back.

6. The system of claim 5, wherein said corresponding connector parts comprise releasable connector parts including at least one of plug and socket connector parts, hook and loop connector parts, belt and buckle connector parts, and magnetic connector parts.

7. The system as claimed in claim 1, wherein said bracket comprises an inverted T-shaped bracket, wherein said bracket comprises a lateral portion and a central longitudinal portion, wherein the ends of said lateral portion comprise pivotable arms and wherein the ends of said lateral portion comprise fixed arms, wherein at least one of said connector parts is provided on each arm, and at least one is provided on the central longitudinal portion, and wherein the pivotably coupled arms are configured to allow for attachment of the harness to the apparatus attachment means for users of various dimensions.

8. The system as claimed in claim 7, wherein said connector parts are incorporated within said arms, wherein said connector part is movable between extended and retracted states by an actuator, and wherein said actuator is resiliently biased to urge the connector part towards the extended state.

9. The system as claimed in claim 7, wherein said bracket has a shoulder support provided thereon at the top end of the central longitudinal portion, wherein said shoulder support is releasably coupleable to the harness, and wherein said shoulder support is configured to support the upper body of the primary user when coupled to the support apparatus in-use.

10. The system as claimed in claim 9, wherein the shoulder support comprises (i) a main portion coupled to the central longitudinal portion of the bracket and (ii) at least two branch portions that extend from the body of the main portion and are configured to wrap around the primary user's shoulders in-use.

11. The system as claimed in claim 10, wherein a shoulder coupling arrangement is provided upon the ends of the branch portions, such that he shoulder coupling arrangement can be releasably connected to a corresponding torso coupling arrangement provided on the harness, and wherein said shoulder and torso coupling arrangements comprise at least one releasable, corresponding connector parts that together provide one or more releasable connectors, wherein one part of each releasable connector being provided on the harness and the respective corresponding other part being provided on the shoulder support.

12. The system as claimed in claim 1, wherein said primary co-operable attachment means comprises co-operable harness and hoist attachments means, said hoist attachment means includes at least one hoist point at which said harness may be releasably coupled to said hoist, wherein said at least one hoist point is located at the shoulder or upper torso region of the harness, wherein at least one respective hoist point is provided on the left of the harness at least one respective hoist point is provided on the right of the harness, and wherein at least one respective hoist point is provided on the front of the harness and at least one respective hoist point is provided on the back of the harness.

13. The system as claimed in claim 12, wherein said hoist attachment means comprises at least one connector provided at each hoist point, and wherein said hoist attachment means comprises at least one respective strap releasably coupled to said harness at each hoist point.

14. A harness for a user, the harness comprising:

a harness body;

a postural support structure comprising a rigid or semi-rigid structure wherein said postural support structure comprises one of a single piece structure and a plurality of individual support members; and a harness attachment means for releasably attaching said harness to a frame, said harness attachment means configured to retain said user, when within said harness, relative to said frame such that rotational movement of said user effects generally simultaneous rotational movement of said frame;

wherein said postural support structure is insertable into and removable from within said harness body.

15. The harness as claimed claim 14, wherein said postural support structure extends in a substantially horizontal or vertical direction within said harness relative to an upright user, wherein said postural support structure comprises a rib like structure which extends substantially around the body of the primary user in use, and wherein said postural support structure is moulded to the user's shape.

16. The harness as claimed in claim 14, wherein said harness attachment means comprises a plurality of connector parts provided on said harness, wherein a respective one of said connector parts is located upon either side of the harness at a respective location corresponding to the user's side or hip, wherein said harness attachment means comprises a respective one of said connector parts located on the back of the harness at a location corresponding to the user's upper back, and wherein said harness incorporates a plurality of thigh straps and arm straps.

17. The harness as claimed in claim 14, wherein said harness comprises first and second portions which are coupleable together at opposing front and rear sides to define a substantially tubular garment, wherein said first and second portions are coupleable together at one side by a releasable coupling and at the opposing side by a fastening arrangement, wherein the releasable coupling is configurable between open and closed states to allow the harness to be easily placed upon a user, and wherein said fastening arrangement is configured to tighten or loosen the harness such as to accommodate users of varying dimension.

18. The harness as claimed in claim 17, wherein said fastening arrangement comprises a strap which extends in a criss-cross manner between the first and second portions, wherein a portion of said strap extends around at least part of the circumference of the harness, and wherein said portion is configured such as to provide means by which the fastening arrangement may be tightened or loosened when the harness is upon the primary user in-use.

19. The harness as claimed in claim 14, wherein said harness includes at least one hoist point at which said harness may be releasably coupled to a hoist.

* * * * *